US008881674B2

(12) United States Patent
Somada et al.

(10) Patent No.: US 8,881,674 B2
(45) Date of Patent: Nov. 11, 2014

(54) CURTAIN COATING APPARATUS AND CURTAIN COATING METHOD

(75) Inventors: Hiroki Somada, Shizuoka (JP); Kazuhisa Yamamoto, Shizuoka (JP); Tetsuya Hara, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 693 days.

(21) Appl. No.: 12/876,700

(22) Filed: Sep. 7, 2010

(65) Prior Publication Data

US 2011/0059254 A1 Mar. 10, 2011

(30) Foreign Application Priority Data

Sep. 8, 2009 (JP) ..... 2009-207247
Aug. 9, 2010 (JP) ..... 2010-178445

(51) Int. Cl.
*B05C 3/02* (2006.01)
*G03C 1/74* (2006.01)

(52) U.S. Cl.
CPC ..... *G03C 1/74* (2013.01); *G03C 2001/747* (2013.01); *Y10S 118/04* (2013.01)
USPC ..... 118/410; 118/419; 118/DIG. 4

(58) Field of Classification Search
CPC ..... B05C 5/005
USPC ..... 118/410, 412, DIG. 4, 402, 404, 419, 118/420, 300, 325; 427/240, 420
See application file for complete search history.

(56) References Cited

U.S. PATENT DOCUMENTS 3,632,374 A 1/1972 Greiller
4,479,987 A 10/1984 Koepke et al.
4,974,533 A * 12/1990 Ishizuka et al. ..... 118/411
6,196,127 B1 3/2001 Yamamoto et al.
6,248,406 B1 * 6/2001 Kondo et al. ..... 427/420
7,081,163 B2 7/2006 Metzger et al.
2001/0020423 A1 9/2001 Yamamoto et al.

(Continued)

FOREIGN PATENT DOCUMENTS

EP 2474368 A1 7/2012
JP 49-35447 9/1974

(Continued)

OTHER PUBLICATIONS

Oct. 21, 2010 European search report in connection with a counterpart European patent application No. 10175603.

(Continued)

*Primary Examiner* — Yewebdar Tadesse
(74) *Attorney, Agent, or Firm* — Cooper & Dunham LLP

(57) ABSTRACT

A curtain coating apparatus including: a pair of edge guides configured to support both side edges of at least one coating liquid so as to form a coating liquid film which falls freely and apply the coating liquid film onto a continuously running support; and an auxiliary water introduction port which allows auxiliary water to be introduced substantially uniformly with respect to a width direction of an edge guide auxiliary water flow-down surface of each edge guide from an upper portion toward a lower portion of the flow-down surface, wherein the flow-down surface has at its upper portion a flat surface portion, and wherein the flow-down surface has at its lower portion an arc-shaped portion which is provided at a center and which protrudes in the shape of an arc, and a flat surface portion which is provided on both sides of the arc-shaped portion.

12 Claims, 16 Drawing Sheets

(56) References Cited

U.S. PATENT DOCUMENTS

| | | | |
|---|---|---|---|
| 2004/0047999 | A1 | 3/2004 | Gugler et al. |
| 2005/0011439 | A1 | 1/2005 | Gueggi et al. |
| 2007/0137563 | A1 | 6/2007 | Schweizer et al. |
| 2010/0018458 | A1 | 1/2010 | Schweizer et al. |

FOREIGN PATENT DOCUMENTS

| | | | |
|---|---|---|---|
| JP | 1-199668 | | 8/1989 |
| JP | 8-192087 | | 7/1996 |
| JP | 2630512 | | 4/1997 |
| JP | 9-253552 | | 9/1997 |
| JP | 2001-46939 | | 2/2001 |
| JP | 2008-529753 | | 8/2008 |
| JP | 2010-22947 | | 2/2010 |
| JP | 2011-50816 | | 3/2011 |
| WO | WO2008/000507 | A1 | 1/2008 |

OTHER PUBLICATIONS

Brown, D.R., (1961), "A study of the behavior of a thin sheet of moving liquid," J. Fluid Mechanis, vol. 10, pp. 297-305.

Havenbergh, J. Van, et al. (1984), "Suction at the Plateau Border of a Free Falling Film," Journal of Colloid and Interface Science, vol. 101, No. 2, pp. 462-466.

Sartor, Luigi (1990), "Slot coating: Fluid mechanics and die design," University of Minnsota.

Kistler, Stephan F., et al. (1997), "Liquid Film Coating: Scientific principles and their technological implications," Chapman & Hall.

European official communication dated Oct. 25, 2012 in connection with corresponding European patent application No. 10175603.9.

Japanese official action dated Apr. 8, 2014 in corresponding Japanese patent application.

* cited by examiner

Cross section taken along line A

Cross section taken along line B

Cross section taken along line C

CURTAIN COATING APPARATUS AND CURTAIN COATING METHOD

BACKGROUND OF THE INVENTION

1. Field of the Invention

The present invention relates to a curtain coating apparatus and a curtain coating method, in which at least one layer of a coating liquid is ejected from a slit, the ejected coating liquid is made to fall freely by means of a pair of curtain edge guides that guide the coating liquid in the form of a curtain, and the coating liquid is thus applied onto a continuously running support.

2. Description of the Related Art

Conventionally, curtain coating methods have been proposed as coating methods for use in the production of photosensitive materials such as photographic films.

Examples of the curtain coating methods include (i) a method in which a coating liquid is ejected from a nozzle slit, made to fall freely by means of a pair of curtain edge guides (which guide the coating liquid in the form of a curtain) and brought into collision with a continuously running support (hereinafter, the term "support" will be referred to also as "web" or "base material") so as to form a coating film; (ii) a method in which a coating liquid is ejected from a slit, moved on a slide surface, made to fall freely by means of a pair of curtain edge guides (which guide the coating liquid in the form of a curtain) and brought into collision with a continuously running web so as to form a coating film; (iii) a method (multilayered coating method) in which coating liquids with different compositions are ejected from respective nozzle slits, made to fall freely by means of a pair of curtain edge guides (which guide the coating liquids in the form of a curtain) and sequentially brought into collision with a continuously running web so as to form a coating film; and (iv) a method (multilayered coating method) in which coating liquids with different compositions are ejected from respective nozzle slits, layered over a slide surface, made to fall freely by means of a pair of curtain edge guides (which guide the coating liquids in the form of a curtain) and brought into collision with a continuously running web so as to form a coating film.

For instance, there has been proposed a method in which a coating liquid 3 is ejected from a nozzle slit of a slot curtain coating head 1, made to fall freely by means of a curtain edge guide 2 (which guides the coating liquid in the form of a curtain) and brought into collision with a continuously running web 5 so as to form a coating film, as shown in FIG. 9; and there has been proposed a method in which a coating liquid is ejected from a slit, moved on a slide surface 8 of a slide curtain coating head 7 (with an edge of the coating liquid being supported by a slide portion edge guide 9), made to fall freely by means of a curtain edge guide 2 (which guides the coating liquid in the form of a curtain) and brought into collision with a continuously running web 5 so as to form a coating film, as shown in FIG. 10 (refer, for example, to Japanese Patent Application Publication (JP-B) No. 49-35447). In FIGS. 9 and 10, there are respective vacuum devices provided.

Examples of multilayered coating methods include a method in which coating liquids with different functions are ejected from respective nozzle slits, made to fall freely by means of a pair of curtain edge guides (which guide the coating liquids in the form of a curtain) and brought into collision with a continuously running web so as to form a coating film; and a method in which coating liquids with different functions are ejected from respective slits, layered over a slide surface, made to fall freely by means of a pair of curtain edge guides (which guide the coating liquids in the form of a curtain) and brought into collision with a continuously running web so as to form a coating film.

In the case where coating liquid(s) is/are applied onto a web by a curtain coating method, instability of a freely falling curtain film has great adverse effects on productivity and product quality.

Typical examples of phenomena in which the stability of a curtain film is hindered include a phenomenon in which a curtain film shifts toward the back (hereinafter referred to as "teapot phenomenon"), and a phenomenon in which the thickness of a curtain film decreases in the vicinities of edge guide walls (refer, for example, to S. F. Kistler, and Schweize "Liquid Film Coating").

The teapot phenomenon is a phenomenon in which a curtain film shifts toward the back of a lip instead of falling vertically. This is due to an imbalance in the momentum of a coating liquid (coating liquid flowing down a slide surface) at a lip edge.

The teapot phenomenon is particularly noticeable when the viscosity of a coating liquid decreases or the amount thereof applied increases, in other words when the Reynolds number is relatively large. Since both edges of the curtain film are supported by a pair of edge guides, arbitrary curving of the curtain film caused by the teapot phenomenon cannot be allowed, and thus the curtain film distorts.

Consequently, the amount of the coating liquid applied is uneven with respect to the width direction of the curtain film, and thus a favorable coating film cannot be obtained.

As a countermeasure against the teapot phenomenon, there has been proposed an edge guide which is curved so as to match the shape of a curtain film (refer, for example, to Japanese Patent Application Laid-Open (JP-A) No. 09-253552).

This proposal makes it possible to eradicate the distortion of a curtain film caused by the teapot phenomenon. However, since the extent of deformation of a curtain film stemming from the teapot phenomenon varies greatly depending upon operational conditions such as the properties of a coating liquid and the flow rate thereof, there is a problem in that it is necessary to change the shape of the edge guide according to the conditions, which is not satisfactory in practical use.

To solve this problem, there has been proposed a flat plate type edge guide, wherein a surface along which edge guide auxiliary water flows down (hereinafter referred to as "edge guide auxiliary water flow-down surface", "auxiliary water flow-down surface" or "flow-down surface") is formed as a flat plate so as to allow for the curtain film curvature that greatly varies depending upon the operational conditions, and the flow-down surface has a width which is sufficient for the deformation amount of the curtain film (refer, for example, to JP-A No. 2001-46939).

However, since the edge guide auxiliary water flow-down surface is a flat plate, the falling position of the curtain film on the edge guide varies due to slight airflow in the vicinity of a curtain coating apparatus or air which accompanies a web. If the variation is great, there is a problem in that the curtain film comes into contact with ends (with respect to the width direction) of the edge guide auxiliary water flow-down surface and so the coating film thickness becomes uneven.

Moreover, there may be a problem in that the falling position of the curtain film on the web varies and thus coating unevenness arises.

There has been proposed an edge guide in which an edge guide auxiliary water flow-down surface has a convex shape at the center with respect to the coating width direction (refer, for example, to International Publication No. WO2008/000507).

It has been confirmed that this proposal makes it possible to secure center adjustability of the edge guide and suppress the occurrence of coating unevenness that stems from the variation in the falling position of a curtain film caused by disturbance.

In this proposal, however, the convex shape of the edge guide auxiliary water flow-down surface has a constant curvature from its upper portion to its lower portion. Therefore, when the curvature of the curtain film related to the teapot phenomenon is great, a three-dimensional liquid flow is created, the curved portion deviates greatly from the apex of the convex shape of the flow-down surface, and consequently a coating liquid flows to a portion which is away from the apex of the convex shape of the edge guide.

The flow of the coating liquid to the portion away from the apex causes widening of the width of the curtain film, and both edges of the curtain film are pulled toward the center with respect to the curtain width direction owing to an increase in the surface tension of the coating liquid. Consequently, the curtain film shifts to the apex of the convex shape and falls down along the apex, and there is a problem in that the curvature of the three-dimensional liquid flow causes unevenness of the thickness of a coating film at its edges.

The phenomenon in which the thickness of a curtain film decreases arises in the vicinities of edge guides, notably anywhere at a distance of approximately several millimeters to approximately 10 mm from each edge guide. A result of research involved in the present invention has revealed that the thickness of the curtain film at such a portion is approximately 60% to approximately 95% of that of the curtain film at a central portion.

When the thin film portion has been applied onto a web, there is a thin film portion formed inside both edges of a coating film, which causes unevenness of coating film thickness and thus loss of coating.

Regarding the film thickness decrease phenomenon, development of a boundary layer, which is due to fluid friction between a free fall portion of the curtain film and the curtain film in the vicinity of each edge guide at the time of the fall of the curtain film, causes the curtain film forming coating liquid in the vicinity of each edge guide to shift toward the center with respect to the curtain width direction. Also, the difference in surface tension between a flow portion of the coating liquid in the vicinity of each edge guide and a steady flow portion of the coating liquid at the center with respect to the curtain width direction, which is due to dynamic properties of a surfactant in the coating liquid, similarly causes the curtain film forming coating liquid to shift toward the center with respect to the curtain width direction.

Meanwhile, it is known that a concave meniscus lying between the coating liquid at each edge guide and the gas phase causes the curtain film forming coating liquid to shift toward each edge guide (refer, for example, to J. Van Havenbergh, H. Bussmann, and P. Joos: Colloid Interface Sci., 101, 462, (1984)).

The unevenness of film thickness is suppressed by securing a favorable balance between the tendency for the curtain film forming coating liquid to shift toward the center with respect to the width direction (which stems from the development of the boundary layer and the difference in surface tension) and the tendency for the curtain film forming coating liquid to shift toward each edge guide (which stems from the concave meniscus) (refer, for example, to Japanese Patent (JP-B) No. 2630512).

As a means for achieving the foregoing, the level of the coating liquid viscosity, the difference in surface tension between a curtain film central portion and curtain film edges, and the dimensions of a liquid contact portion of each edge guide are defined so as to secure a favorable balance as described above.

This method enables uniformity of film thickness. In reality, however, in view of the product deign, it is difficult to limit the difference in surface tension when there is a formulation-related restriction, such as a restriction on properties of the coating liquid, provided to achieve high coating film quality. Thus, there is a problem in that the uniformity can be realized only under limited coating liquid conditions.

Also, a result of research involved in the present invention has revealed that a thick film portion exists on the inside (with respect to the curtain film width direction) of the thin film portion. However, a method for reducing the thick film portion has not hitherto been disclosed as opposed to methods relating to the thin film portion.

In the above-mentioned curtain coating methods, there is a phenomenon caused in which when the coating liquid falls freely, a portion (boundary layer) where the coating liquid flows slowly exists near each edge of the curtain film, and the difference in flow velocity causes the coating liquid near both edges of the curtain film to flow toward the center in a contracted manner. Thus, when the coating liquid is brought into collision with the continuously running web so as to form a coating film, there is a problem in that a thin film portion 120*a* (FIG. 11) forms near edges (with respect to the width direction) of a coating film 20 (FIG. 1) and a thick film portion 120*b* (FIG. 11) forms on an inner side (with respect to the width direction) of the coating film 20.

To prevent formation of the boundary layer in the curtain film, there has been proposed a technique in which by defining the viscosity and surface tension of the coating liquid and the shape of a liquid contact surface of each edge guide, formation of the boundary layer in the curtain film is suppressed, the formation of the thin film portion 120*a* and the thick film portion 120*b* caused by the flow of the coating liquid in a contracted manner is thereby prevented, and uniformity of coating film thickness is thus achieved (refer, for example, to JP-B No. 2630512).

However, this technique presents problems in that effects of the boundary layer can be lessened only under limited property conditions of the coating liquid and it is very difficult to regulate the viscosity and surface tension of the coating liquid.

Further, to prevent formation of the boundary layer in the curtain film, there has been proposed a technique in which by discharging an edge guide auxiliary liquid (in the direction in which a coating liquid flows down) to edge guides, formation of a boundary layer near each edge of a curtain film is prevented (refer, for example, to JP-A No. 01-199668).

However, this technique presents a problem in that the acceleration of the curtain film yielded by the edge guide auxiliary liquid does not suffice and thus formation of a boundary layer cannot be eradicated.

To stabilize the free fall of the coating liquid, there has been proposed a technique for exhibiting center adjustability of a curtain film, wherein an edge guide auxiliary liquid flow-down surface has an arc-like convex shape; thus, when there is no wind-based disturbance, a curtain film is positioned at the apex of the convex portion, and when the curtain film has deviated from the apex of the convex portion owing to wind-based disturbance, the deviating curtain film is returned to the apex of the convex portion by increasing the dynamic surface tension of the coating liquid (refer, for example, to 2008-529753).

However, this technique presents a problem in that when the static surface tension of the coating liquid is as small as approximately 35 mN/m, the curtain film deviates from the apex of the convex portion and adheres to a side surface of an edge guide owing to wind-based disturbance, thereby leading to unevenness of the curtain film. Also, this technique presents another problem in that as the coating liquid falls non-linearly, the uniformity of a coating film is impaired, and coating unevenness arises. Further, this technique presents yet another problem in that a porous material for ejecting the edge guide auxiliary liquid is clogged with the coating liquid, thereby leading to uneven ejection of the edge guide auxiliary liquid.

If the coating liquid is attached to the porous material, it is washed off using a solvent such as hydrochloric acid. However, a difficult decomposing operation and the like are required and removal of the clogging is difficult, so that there is strong demand for development of clogging-free edge guides.

To solve the problem of clogging, there has been proposed a technique in which an edge guide auxiliary water flow-down surface is formed as a metal surface, and auxiliary water is ejected from an ejection port provided in the metal surface (refer, for example, to U.S. Pat. No. 7,081,163).

However, this technique relates to a structure in which the edge guide auxiliary water directly flows into the ejection port and thus presents a problem in that it is difficult to eject the edge guide auxiliary water uniformly, another problem in that since the edge guide auxiliary water flow-down surface is a flat surface, the auxiliary liquid does not fall linearly and so an unstable curtain film is formed, and yet another problem in that the curtain film does not shake owing to wind-based disturbance.

BRIEF SUMMARY OF THE INVENTION

The present invention is aimed at solving the above-mentioned problems in related art and achieving the following object.

An object of the present invention is to provide a curtain coating apparatus and a curtain coating method, which are capable of preventing distortion of a curtain film caused by the teapot effect (which is a phenomenon peculiar to curtain coating methods) and also capable of suppressing variation in the falling position of the curtain film caused by disturbance and suppressing both a film thickness decrease phenomenon and a film thickness increase phenomenon.

The present invention is also aimed at achieving the following other object. Another object of the present invention is to provide a curtain coating apparatus and a curtain coating method, which are capable of preventing a curtain film from becoming unstable (which is caused by the turbulence of auxiliary water and wind-based disturbance) and also capable of suppressing increase in the thickness of the curtain film caused by a boundary layer in the vicinity of each guiding unit, even if the surface tension of the auxiliary water is low.

Means for solving the problems are as follows.

<1> A curtain coating apparatus including:

a pair of edge guides configured to support both side edges of at least one coating liquid so as to form a coating liquid film which falls freely and apply the coating liquid film onto a continuously running support; and an auxiliary water introduction port which allows auxiliary water to be introduced substantially uniformly with respect to a width direction of an edge guide auxiliary water flow-down surface of each edge guide from an upper portion toward a lower portion of the edge guide auxiliary water flow-down surface, wherein the edge guide auxiliary water flow-down surface has at its upper portion a flat surface portion which is substantially in the form of a flat surface, and wherein the edge guide auxiliary water flow-down surface has at its lower portion an arc-shaped portion which is provided at a center with respect to the width direction and which protrudes in the shape of an arc, and a flat surface portion which is provided on both sides of the arc-shaped portion with respect to the width direction.

<2> The curtain coating apparatus according to <1>, wherein the arc-shaped portion has a curvature radius of 2 mm to 5 mm.

<3> The curtain coating apparatus according to <1> or <2>, wherein there is a continuous shape change from the flat surface portion at the upper portion of the edge guide auxiliary water flow-down surface to the arc-shaped portion at the lower portion of the edge guide auxiliary water flow-down surface.

<4> The curtain coating apparatus according to any one of <1> to <3>, wherein the edge guide auxiliary water flow-down surface has arc-shaped areas provided along oblique sides of an inverted isosceles triangle which connect a center line of the arc-shaped portion with respect to the width direction with both ends of the flat surface portion provided at the upper portion of the edge guide auxiliary water flow-down surface.

<5> The curtain coating apparatus according to <4>, wherein the distance between the auxiliary water introduction port and an apex of the isosceles triangle is in the range of 10 mm to 35 mm.

<6> The curtain coating apparatus according to any one of <1> to <5>, wherein the auxiliary water is introduced at a rate of 0.40 m/sec to 1.20 m/sec.

<7> A curtain coating apparatus including:

an ejecting unit having a coating liquid ejection port, configured to eject a coating liquid from the coating liquid ejection port;

a pair of guiding units each having an auxiliary water introduction port through which auxiliary water is introduced, configured to support both edges of a curtain film with respect to a width direction substantially perpendicular to the direction in which the curtain film formed of the coating liquid flows down, and guide the curtain film onto a support conveyed; and a conveying unit configured to convey the support, wherein the pair of guiding units each have a concave portion through which the auxiliary water flows down, and wherein a side surface of the concave portion formed substantially perpendicularly to a bottom surface of the concave portion forms an acute angle with an exposed surface formed so as to be continuous with the side surface and intersect the side surface.

<8> The curtain coating apparatus according to <7>, wherein the concave portion has a maximum depth of 0.2 mm to 0.5 mm.

<9> The curtain coating apparatus according to <7> or <8>, wherein the maximum distance between the side surface and the other side surface of the concave portion is in the range of 1.5 mm to 4.0 mm.

<10> The curtain coating apparatus according to any one of <7> to <9>, wherein each guiding unit has a flat surface above the auxiliary water introduction port with respect to the direction in which the auxiliary water flows down, and wherein the flat surface is a rectangle which measures 5 mm to 15 mm long and 7 mm or more wide.

<11> The curtain coating apparatus according to any one of <7> to <10>, wherein the auxiliary water is introduced at a rate of 0.4 m/sec to 2.1 m/sec.

<12> The curtain coating apparatus according to any one of <7> to <11>, wherein the auxiliary water introduction port has a maximum gap of 0.2 mm to 0.5 mm with respect to the direction in which the auxiliary water flows down.

<13> A curtain coating method including:

supporting both side edges of at least one coating liquid with a pair of edge guides so as to form a coating liquid film which falls freely and apply the coating liquid film onto a continuously running support; and introducing auxiliary water through an auxiliary water introduction port, substantially uniformly with respect to a width direction of an edge guide auxiliary water flow-down surface of each edge guide, from an upper portion toward a lower portion of the edge guide auxiliary water flow-down surface, wherein the edge guide auxiliary water flow-down surface has at its upper portion a flat surface portion which is substantially in the form of a flat surface, and wherein the edge guide auxiliary water flow-down surface has at its lower portion an arc-shaped portion which is provided at a center with respect to the width direction and which protrudes in the shape of an arc, and a flat surface portion which is provided on both sides of the arc-shaped portion with respect to the width direction.

<14> The curtain coating method according to <13>, wherein the arc-shaped portion has a curvature radius of 2 mm to 5 mm.

<15> The curtain coating method according to <13> or <14>, wherein there is a continuous shape change from the flat surface portion at the upper portion of the edge guide auxiliary water flow-down surface to the arc-shaped portion at the lower portion of the edge guide auxiliary water flow-down surface.

<16> The curtain coating method according to any one of <13> to <15>, wherein the edge guide auxiliary water flow-down surface has arc-shaped areas provided along oblique sides of an inverted isosceles triangle which connect a center line of the arc-shaped portion with respect to the width direction with both ends of the flat surface portion provided at the upper portion of the edge guide auxiliary water flow-down surface.

<17> The curtain coating method according to <16>, wherein the distance between the auxiliary water introduction port and an apex of the isosceles triangle is in the range of 10 mm to 35 mm.

<18> The curtain coating method according to any one of <13> to <17>, wherein the auxiliary water is introduced at a rate of 0.40 m/sec to 1.20 m/sec.

<19> A curtain coating method including:

ejecting a coating liquid from a coating liquid ejection port;

supporting both edges of a curtain film with respect to a width direction substantially perpendicular to the direction in which the curtain film formed of the coating liquid flows down, and guiding the curtain film onto a support conveyed, by using a pair of guiding units each having an auxiliary water introduction port through which auxiliary water is introduced; and conveying the support, wherein the pair of guiding units each have a concave portion through which the auxiliary water flows down, and wherein a side surface of the concave portion formed substantially perpendicularly to a bottom surface of the concave portion forms an acute angle with an exposed surface formed so as to be continuous with the side surface and intersect the side surface.

<20> The curtain coating method according to <19>, wherein the concave portion has a maximum depth of 0.2 mm to 0.5 mm.

<21> The curtain coating method according to <19> or <20>, wherein the maximum distance between the side surface and the other side surface of the concave portion is in the range of 1.5 mm to 4.0 mm.

<22> The curtain coating method according to any one of <19> to <21>, wherein each guiding unit has a flat surface above the auxiliary water introduction port with respect to the direction in which the auxiliary water flows down, and wherein the flat surface is a rectangle which measures 5 mm to 15 mm long and 7 mm or more wide.

<23> The curtain coating method according to any one of <19> to <22>, wherein the auxiliary water is introduced at a rate of 0.4 m/sec to 2.1 m/sec.

<24> The curtain coating method according to any one of <19> to <23>, wherein the auxiliary water introduction port has a maximum gap of 0.2 mm to 0.5 mm with respect to the direction in which the auxiliary water flows down.

The present invention makes it possible to solve the above-mentioned problems in related art and achieve the object of providing a curtain coating apparatus and a curtain coating method, which are capable of preventing distortion of a curtain film caused by the teapot effect (which is a phenomenon peculiar to curtain coating methods) and also capable of suppressing variation in the falling position of the curtain film caused by disturbance and suppressing both a film thickness decrease phenomenon and a film thickness increase phenomenon.

The present invention also makes it possible to achieve the other object of providing a curtain coating apparatus and a curtain coating method, which are capable of preventing a curtain film from becoming unstable (which is caused by the turbulence of auxiliary water and wind-based disturbance) and also capable of suppressing increase in the thickness of the curtain film caused by a boundary layer in the vicinity of each guiding unit, even if the surface tension of the auxiliary water is low.

DETAILED DESCRIPTION OF THE INVENTION

Figure 1:
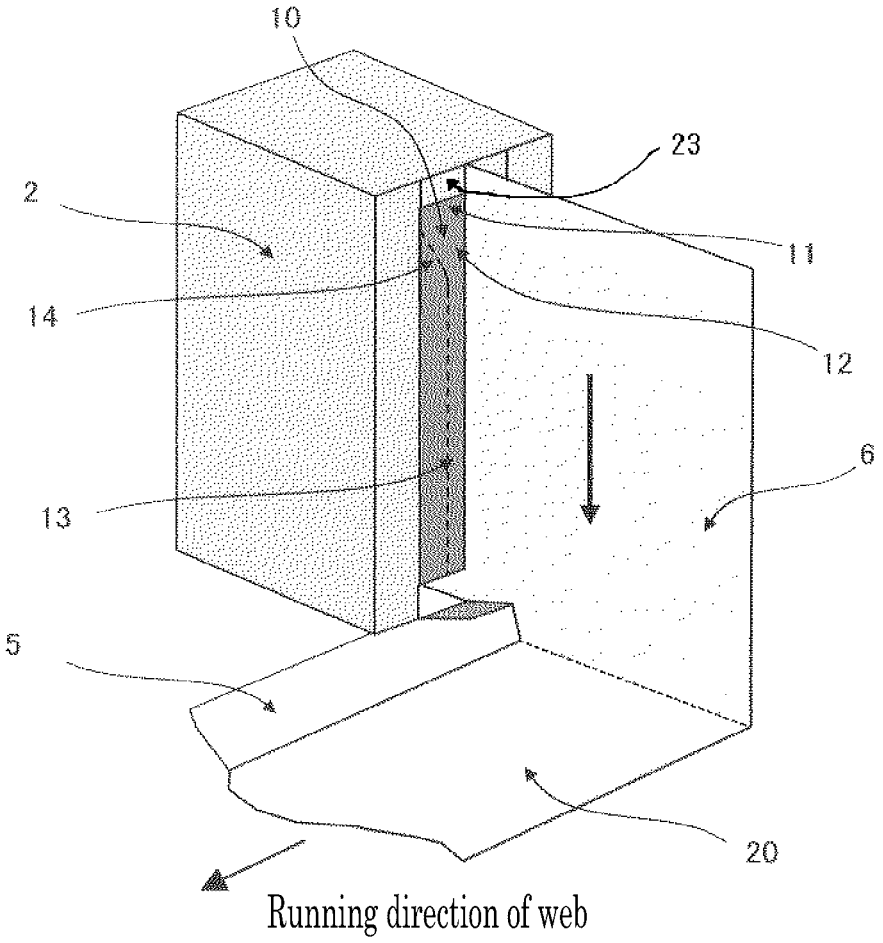
FIG. 1 is a schematic drawing showing an example of an edge guide in a curtain coating apparatus of the present invention.

The following explains a first embodiment of the present invention in detail.

(Curtain Coating Apparatus and Curtain Coating Method)

A curtain coating apparatus of the present invention includes: a pair of edge guides configured to support both side edges of at least one coating liquid so as to form a coating liquid film which falls freely and apply the coating liquid film onto a continuously running support; and an auxiliary water introduction port. If necessary, the curtain coating apparatus may further include suitably selected other unit(s).

A curtain coating method of the present invention includes the steps of; supporting both side edges of at least one coating liquid with a pair of edge guides so as to form a coating liquid film which falls freely and apply the coating liquid film onto a continuously running support; and introducing auxiliary water. If necessary, the curtain coating method may further include suitably selected other step(s).

<Auxiliary Water Introduction Port and Step of Introducing Auxiliary Water>

The auxiliary water introduction port allows auxiliary water to be introduced substantially uniformly with respect to a width direction of an edge guide auxiliary water flow-down surface of each edge guide from an upper portion toward a lower portion of the edge guide auxiliary water flow-down surface. The step of introducing auxiliary water is a step of introducing auxiliary water substantially uniformly with respect to a width direction of an edge guide auxiliary water flow-down surface of each edge guide from an upper portion toward a lower portion of the edge guide auxiliary water flow-down surface.

—Edge Guide Auxiliary Water Flow-down Surface—

The edge guide auxiliary water flow-down surface has a flat surface portion (which is substantially in the form of a flat surface) at its upper portion and has an arc-shaped portion (which is provided at a center with respect to the width direction and which protrudes in the shape of an arc) and a flat surface portion (which is provided on both sides of the arc-shaped portion with respect to the width direction) at its lower portion.

—Arc-Shaped Portion—

The curvature radius of the arc-shaped portion is not particularly limited and may be suitably selected according to the intended purpose. Nevertheless, the curvature radius is preferably in the range of 2 mm to 5 mm, more preferably 3 mm to 4 mm.

When the curvature radius is less than 2 mm, it may be difficult for the edge guide auxiliary water to flow down uniformly on the surface of the arc-shaped portion. When the curvature radius is greater than 5 mm, the force with which a curtain film is held on the arc-shaped portion may decrease. Conversely, when the curvature radius is in the more preferred range, there is an advantage in that the curtain film is favorably held on the arc-shaped portion of the edge guide and thus stable coating is enabled.

There is a continuous shape change from the flat surface portion at the upper portion of the edge guide auxiliary water flow-down surface to the arc-shaped portion at the lower portion of the edge guide auxiliary water flow-down surface.

Figure 2:
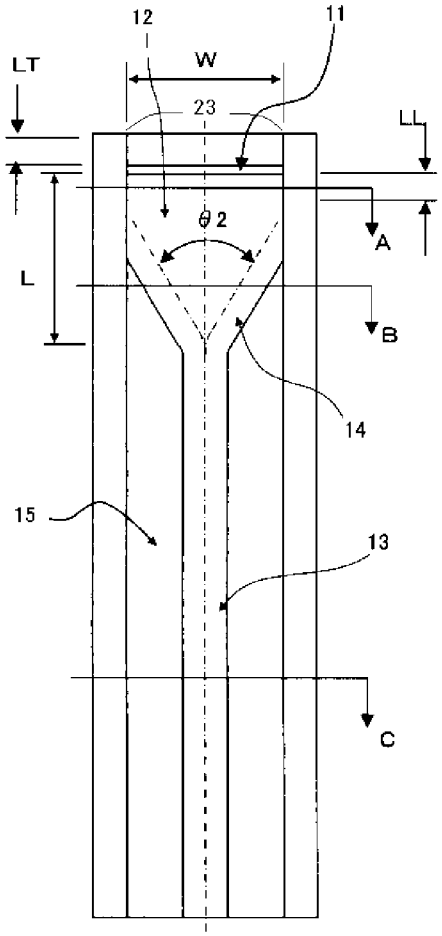
FIG. 2 is a front elevational view showing an example of an edge guide in a curtain coating apparatus of the present invention.

The edge guide auxiliary water flow-down surface has arc-shaped areas provided along oblique sides of an inverted isosceles triangle which connect a center line (with respect to the width direction) of the arc-shaped portion with both ends of the flat surface portion provided at the upper portion of the edge guide auxiliary water flow-down surface (see FIG. 2).

Here, the distance between the auxiliary water introduction port and an apex of the isosceles triangle is not particularly limited and may be suitably selected according to the intended purpose. Nevertheless, the distance is preferably in the range of 10 mm to 35 mm, more preferably 10 mm to 25 mm.

When the distance is less than 10 mm, the distance is not sufficient to allow for curvature of the curtain film caused by the so-called teapot phenomenon at the time of the free falling of the curtain film from the lower edge of a slide die, and thus the curtain film may be disturbed. When the distance is greater than 35 mm, the teapot phenomenon can be allowed for, but the distance between the auxiliary water introduction port and the apex of the isosceles triangle is long, so that it is difficult for the auxiliary water to flow down uniformly and thus the curtain film may be unstable. Conversely, when the distance is in the more preferred range, there is an advantage in that the teapot effect can be avoided and thus the auxiliary water flows down uniformly.

In the case of a slot die curtain coating apparatus, the teapot effect does not arise, so that the flat surface portion in the shape of the inverted isosceles triangle is not required, and there is no problem if no flat surface portion is provided.

The rate at which the auxiliary water is introduced (hereinafter referred to also as "introduction rate (of the auxiliary water)") is not particularly limited and may be suitably selected according to the intended purpose. Nevertheless, the introduction rate is preferably in the range of 0.40 m/sec to 1.20 m/sec, more preferably 0.6 m/sec to 1.0 m/sec.

When the introduction rate is lower than 0.40 m/sec, an increase in the fall velocity of the curtain film in the vicinity of each edge guide is insufficient, so that a boundary layer may be formed in the curtain film owing to the fall velocity difference between the curtain film in the vicinity of each edge guide and the curtain film at the center and thus there may be unevenness of the thickness of the curtain film. When the introduction rate is higher than 1.20 m/sec, the amount of the edge guide auxiliary water is so large that the curtain film may be disturbed at the flat surface portion in the shape of the inverted isosceles triangle and turbulent flow may arise at the lower portion of the edge guide. Conversely, when the introduction rate is in the more preferred range, there is an advantage in that the curtain film can be made uniform and stable.

The maximum gap of the auxiliary water introduction port with respect to the flow-down direction of the auxiliary water is not particularly limited and may be suitably selected. Nevertheless, the maximum gap is preferably in the range of 0.20 mm to 0.50 mm.

The following specifically explains the first embodiment of the present invention, referring to the drawings.

FIG. 1 shows an example of an edge guide in the present invention.

In the present invention, at an upper portion of an edge guide main body (2), there is provided a slit (auxiliary water introduction port) (11) which allows edge guide auxiliary water (10) to be introduced downward and substantially uniformly with respect to a width direction of an edge guide auxiliary water flow-down surface (23).

A curtain film (6) falls in the direction shown by the arrow, and each edge of the curtain film (6) is supported by the edge guide auxiliary water (10) that falls along the edge guide auxiliary water flow-down surface (23) of the edge guide main body (2).

Figure 3:
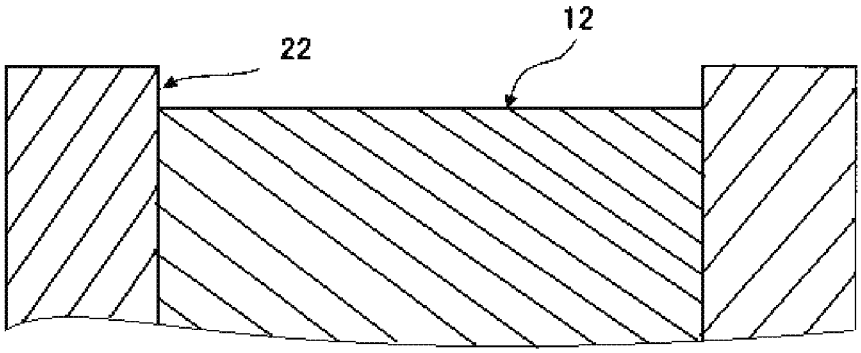
FIG. 3 is an "A cross section" drawing showing an example of an edge guide in a curtain coating apparatus of the present invention.
Figure 4:
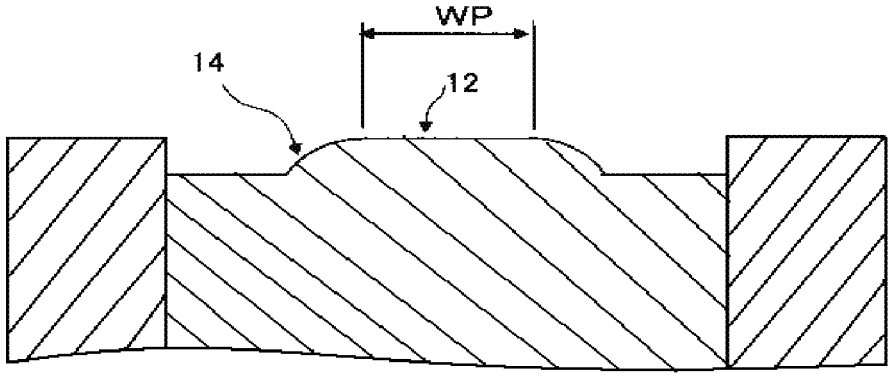
FIG. 4 is a "B cross section" drawing showing an example of an edge guide in a curtain coating apparatus of the present invention.
Figure 5:
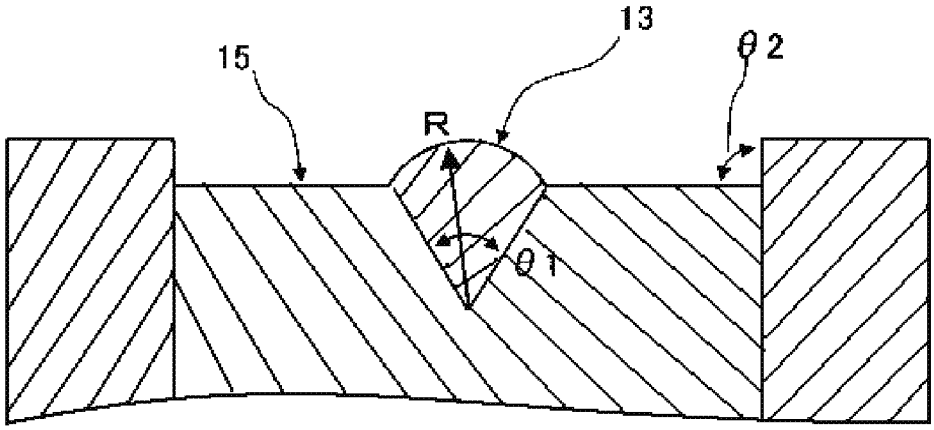
FIG. 5 is a "C cross section" drawing showing an example of an edge guide in a curtain coating apparatus of the present invention.

FIG. 2 shows a front elevational view of an edge guide auxiliary water flow-down portion in the present invention; FIG. 3 shows a cross section of an upper portion thereof, taken along the line A in FIG. 2; FIG. 4 shows a cross section of a middle portion thereof, taken along the line B in FIG. 2; and FIG. 5 shows a cross section of a lower portion thereof, taken along the line C in FIG. 2.

As shown in FIG. 3, the upper portion of the edge guide auxiliary water flow-down surface (23) has a flat surface shape (flat surface portion) (12). As shown in FIG. 5, regarding the cross-sectional shape of the lower portion, its center with respect to the width direction corresponds to the center of the coating width and is provided with an arc-ended convex portion (13). The arc-ended convex portion (13) has a predetermined range of an angle θ1, and there is a flat surface shape portion (15) provided on both sides of the arc-ended convex portion (13).

In FIG. 4, there is an oblique side convex arc-shaped portion (14) formed.

Figure 6:
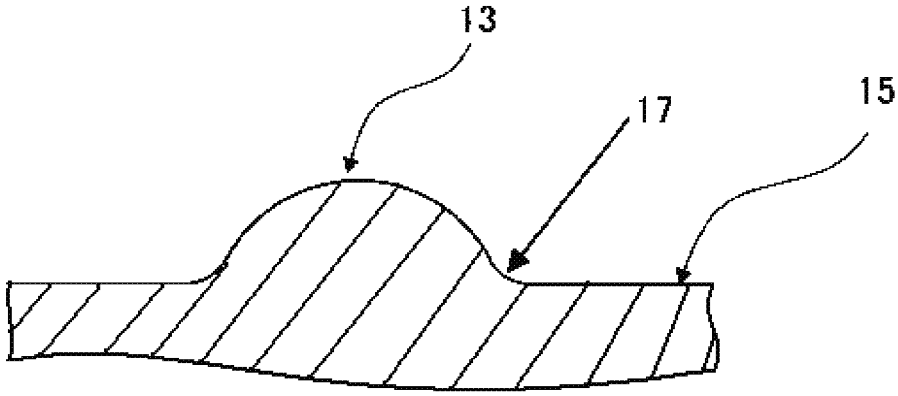
FIG. 6 is a drawing showing an example of an edge guide in a curtain coating apparatus of the present invention (Part 1).
Figure 7:
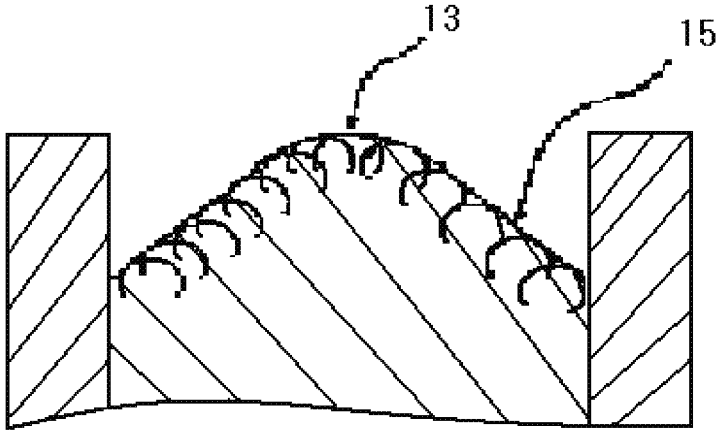
FIG. 7 is a drawing showing an example of an edge guide in a curtain coating apparatus of the present invention (Part 2).

A connecting portion provided between the arc-ended convex portion (13) and the flat surface shape portion (15) is preferably made as smooth as possible so as to secure uniformity of the fall velocity of the edge guide auxiliary water (10) with respect to the width direction. The connecting portion may be a connecting portion (17) as shown in FIG. 6 or may be an end of the flat surface shape portion (15), which is formed by extending a tangent to the arc of the arc-ended convex portion (13), as shown in FIG. 7.

It is desirable that the angle θ1 be in the range of 30 degrees to 90 degrees. When the angle θ1 is so large as to be outside this range, the edge guide auxiliary water (10) may spread to both sides at the transitional portion between the flat surface portion (12) at the upper portion of the edge guide auxiliary water flow-down surface (23) and the arc-ended convex portion (13), and thus the edge guide auxiliary water (10) may not flow along the arc-ended convex portion (13).

The flat surface shape of the flat surface portion (12) at the upper portion of the edge guide auxiliary water flow-down surface (23) makes it possible to allow arbitrary curving of the curtain film (6) caused by the teapot phenomenon.

Furthermore, the arc-ended convex portion (13) at the lower portion of the edge guide auxiliary water flow-down surface (23) makes it possible to solve the problem of poor center adjustability of a curtain film at an edge guide.

As just described, the flat surface portion (12) at the upper portion of the edge guide auxiliary water flow-down surface (23) and the arc-ended convex portion (13) at the lower portion thereof make it possible to solve the problems with existing edge guides at the same time.

The chord length of the arc-ended convex portion (13) is small in comparison with the width (W) of the edge guide auxiliary water flow-down surface (23). Accordingly, provision of a flat surface on both sides of the arc-shaped portion enables the fall velocity of the edge guide auxiliary water (10) (which flows down substantially uniformly with respect to the entire width of the flow-down surface) to be substantially constant with respect to the upper and lower surfaces of the flow-down surface.

The flat surface has a function of temporarily supporting the curtain film (6) in case the curtain film (6) greatly curves owing to the teapot phenomenon or the falling position of the curtain film (6) greatly varies owing to airflow in the vicinity of the coating portion, and thus it deviates from the arc-ended convex portion (13).

A result of research involved in the present invention has revealed that when the fall velocity of the edge guide auxiliary water (10) has a distribution with respect to the width direction, especially when the flow velocity at the center of the edge guide auxiliary water flow-down surface is small and the flow velocity at both side edges thereof is large, there is a problem caused in that the curtain film (6) supported by the edge guide auxiliary water (10) is pulled toward both side edges owing to the difference between its velocity at the center and its velocity at both side edges, and thus it is impossible to allow the curtain film (6) to fall accurately at an intended position.

Conversely, when the flow velocity at the center of the edge guide auxiliary water flow-down surface (23) is large and the flow velocity at both side edges thereof is small, the falling position of the curtain film is stable; however, since the amount of the edge guide auxiliary water (10) increases locally, edges of a film formed of the coating liquid applied onto a web (5) vary in coating liquid amount and thus lack linearity, thereby causing loss of coating at the edges.

Further, when the fall velocity of the edge guide auxiliary water (10) has a distribution with respect to the width direction, there is a case where the curtain film (6) falling in such a manner as to deform owing to the teapot phenomenon is pulled toward the higher velocity sides with respect to the width direction and further deforms, which causes unevenness of the thickness of the curtain film (6) and thus causes the film (A) (formed of the coating liquid applied onto the web (5)) to vary in coating liquid amount.

As described above, the ejection uniformity (with respect to the width direction) of the slit (11) provided in the flat surface portion (12) at the upper portion of the edge guide auxiliary water flow-down surface is important.

In the present invention, since the slit (11) is provided primarily in the flat surface portion, it is easy to eject the edge guide auxiliary water (10) uniformly with respect to the width direction.

Figure 10:
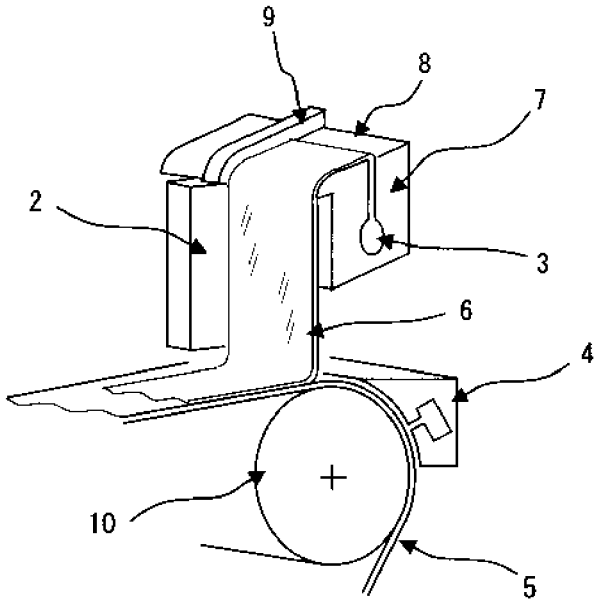
FIG. 10 is a drawing showing an example of a slide curtain coating apparatus.
Figure 11:
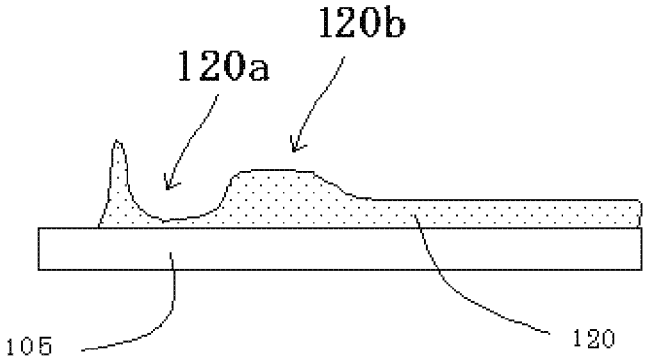
FIG. 11 is a drawing for explaining a thin film portion and a thick film portion of a coating film.

As shown in FIG. 10, a flow path for edge guide auxiliary water (10), provided in an edge guide main body (2), basically has the same structure as the internal structure of a so-called slot die or curtain die, and the internal width thereof is approximately the same as the ejection width of the slit (11) shown in FIG. 1.

Figure 8:
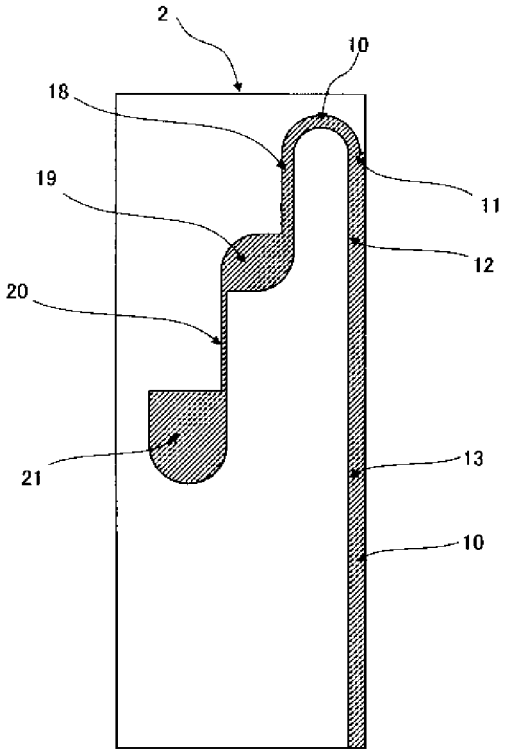
FIG. 8 is a cross-sectional view showing an example of an edge guide in the present invention.
Figure 9:
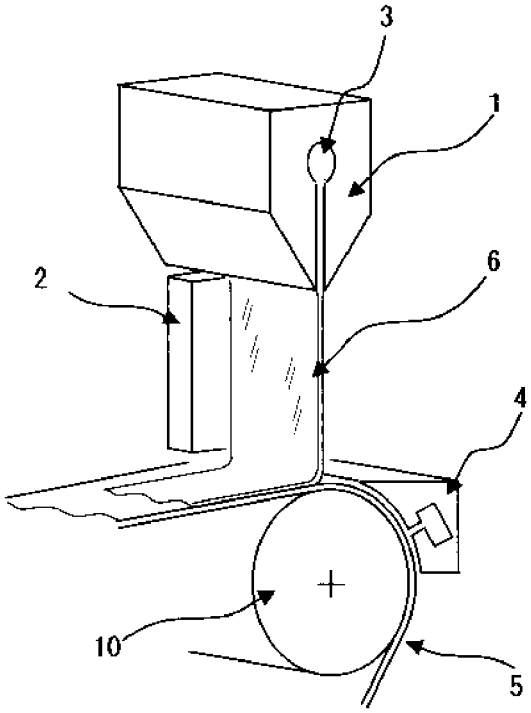
FIG. 9 is a drawing showing an example of a slot curtain coating apparatus.

The edge guide auxiliary water (10) is supplied through an inlet (not shown) to a first manifold (21) shown in FIG. 8, the flow of the edge guide auxiliary water (10) is adjusted with respect to a width direction by a second manifold (19) and slots (18) and (20), and the edge guide auxiliary water (10) is ejected through a slit (11).

Each manifold is generally of single or double type. Employment of a manifold of double type further improves ejection uniformity with respect to the width direction.

As for the shape of a flow outlet, the width of an internal flow path is small in comparison with the ejection width of the edge guide auxiliary water, there is a large gap (0.5 mm to 1.5 mm) provided for the flow outlet, and there is a fan-shaped portion expanding in the vicinity of an exit. Therefore, conditions under which the edge guide auxiliary water flows out uniformly with respect to the width direction are limited.

A result of research involved in the present invention has revealed that when a slit gap of approximately 0.2 mm to approximately 0.5 mm in size is provided, ejection uniformity of the slit (11) with respect to the width direction can be obtained.

Regarding the example shown in FIG. 10, uniformity of flow velocity with respect to the width direction can be obtained by either increasing the volume of the first manifold (21) or reducing the gap for the first slot (20).

Also, further uniformity can be obtained by providing the second manifold (19).

The front elevational view of FIG. 2 and the "C cross section" drawing of FIG. 5 both concerning an edge guide auxiliary water flow-down portion in the present invention show a shape change from the flat surface portion (12) (at the upper portion of the edge guide auxiliary water flow-down surface) to the arc-ended convex portion (13) (at the lower portion thereof). There is formed an inverted isosceles triangle whose oblique sides connect a center line (with respect to the width direction) of the arc-ended convex portion (13) with both ends of the flat surface portion (12). Areas provided along the oblique sides of the isosceles triangle are in the shape of convex arcs with respect to the direction of the coating width center.

The "B cross section" shown in FIG. 4 represents a part of the transitional section between the "A cross section" shown in FIG. 3 and the "C cross section" shown in FIG. 5. The width WP of the flat surface portion (12), shown in FIG. 4, decreases with respect to a downward direction, and eventually equals zero (WP=0), which gives the "C cross section" shown in FIG. 5.

Regarding the "B cross section", when the falling position of the curtain film (6) which has been curved at the oblique sides of the inverted isosceles triangle owing to the teapot phenomenon deviates from the position of the arc-ended convex portion (13), the falling position of the curtain film (6) is corrected, and the curtain film (6) is guided to the arc-ended convex portion (13).

If the transitional section is not provided and there is a direct shape change from the flat surface portion (12) to the arc-ended convex portion (13), the curtain film (6) is disturbed by a large level difference at the boundary therebetween, which causes unevenness of the thickness of edges of a coating film.

As a means for avoiding this problem, it is possible to employ a section that allows the flow of each edge of the curtain film (6) on the edge guide (which has been curved owing to the teapot phenomenon) to advance in the vertical direction by increasing the length of the flat surface portion (12).

In this case, however, since the length of the flat surface section is great, the position of the curtain film (6) varies in the flat surface section owing to disturbance such as airflow in the vicinity of the coating portion, and thus it is impossible to stably guide the curtain film (6) to the arc-ended convex portion (13).

As described above, when the areas provided along the oblique sides at the transitional section shown by the "B cross section" are in the shape of arcs with respect to the direction of the coating width center, the curtain film (6) increases in center adjustability, thereby making it possible to achieve stable operation and reduce loss of coating.

It is desirable that the angle θ2 shown in FIG. 2 be made as small as possible.

As the angle θ2 becomes smaller, the falling direction of the curtain film trapped at the oblique sides of the isosceles triangle becomes closer to the vertical direction, and the extent of deformation of the curtain film becomes smaller. Conversely, as the angle θ2 becomes larger, it becomes easier for the curtain film trapped at the oblique sides to deform, and consequently, easier for coating unevenness to arise.

Due to such phenomena, it is desirable that the LL dimension at the upper portion, shown in FIG. 2, be made small as well.

Since the edge guide auxiliary water does not flow down in the section represented by the LT dimension at the top, shown in FIG. 2, the fall velocity of the curtain film is low. Since this can encourage a decrease in the thickness of each edge of the curtain film, it is desirable that the LT dimension be small.

Although it depends upon the extent of curvature of the curtain film (6), the distance L between the slit (11) at the upper portion of the edge guide auxiliary water flow-down surface and the apex of the inverted isosceles triangle, shown in FIG. 2, is preferably in the range of 10 mm to 35 mm.

A result of research involved in the present invention has revealed that the distance L is preferably 20 mm or so, in the case where the width of the edge guide auxiliary water flow-down surface (23) is 20 mm (in other words where the distance of each edge of the edge guide auxiliary water flow-down surface (23) from its center with respect to the width direction is 10 mm), under the conditions that an acrylic emulsion adhesive having a liquid viscosity of 250 mPa·s to 1,500 mPa·s and a liquid surface tension of 30 mN/m to 40 mN/m is applied at a flow rate of 1.25 cc/cm·sec to 2.5 cc/cm·sec and the edge guide auxiliary water (10) is applied in an amount of 100 cc/min to 300 cc/min per 6.5 mm as a width of the edge guide auxiliary water flow-down surface (23).

When the distance L is 35 mm, the curvature of the curtain film (6) caused by the teapot phenomenon can be easily allowed for. However, the distance L is so great that there tends to be an adverse effect related to the variation in the falling position of the curtain film (6) caused by wind in the vicinity of the coating portion.

It is desirable that the curvature radius R of the arc-like convex shape, shown in FIG. 5, be in the range of 2 mm to 5 mm.

In research involved in the present invention, as a result of examining the limit to which the curtain film (6) can be held, by tilting the edge guide main body (2) in the direction of a surface which is at right angles to the coating width direction (with the vertical direction being a reference direction) under the conditions that a thermosensitive layer solution (for thermal paper) {solid content concentration (S.C.): 29.9%, viscosity: 250 mPa·s, (B-type viscometer) liquid surface tension: 39 mN/m (static surface tension in a platinum plate method)} having a liquid viscosity of 250 mPa·s and a liquid surface tension of 39 mN/m is applied at a flow rate of 2.5 cc/cm·sec and the edge guide auxiliary water (10) is applied in an amount of 100 cc/min per 6.5 mm as a width of the edge guide auxiliary water flow-down surface, the following has been found: when the curvature radius is smaller than 2 mm, it is difficult for the edge guide auxiliary water (10) to flow down uniformly with respect to the width direction, irrespective of center adjustability; when the curvature radius is 3 mm, the force with which the curtain film is held is greatest; and when the curvature radius is larger than 5 mm, the force with which the curtain film is held decreases sharply.

The curvature radius R of the arc-like convex shape provided along each oblique side of the inverted isosceles triangle is not particularly limited. When this curvature radius R is (approximately) equal to the curvature radius R of the arc-like convex shape shown in FIG. 5, facilitation can be yielded in terms of processing and production, and the production cost of the edge guide can thereby be reduced.

Although it depends upon the curvature of the curtain film (6), the width of the edge guide auxiliary water flow-down surface (23) is preferably in the range of 7 mm to 20 mm.

A result of research involved in the present invention has revealed that the curtain film (6) does not come into contact with edges of the edge guide auxiliary water flow-down surface (23) with respect to the width direction, in the case where the width of the edge guide auxiliary water flow-down surface (23) is 20 mm (in other words where the distance of each edge of the edge guide auxiliary water flow-down surface (23) from its center with respect to the width direction is 10 mm), under the conditions that an acrylic emulsion adhesive having a liquid viscosity of 250 mPa·s to 1,500 mPa·s and a liquid surface tension of 30 mN/m to 40 mN/m is applied at a flow rate of 1.25 cc/cm·sec to 2.5 cc/cm·sec and the edge guide auxiliary water (10) is applied in an amount of 100 cc/min to 300 cc/min per 6.5 mm as a width of the edge guide auxiliary water flow-down surface (23). However, in the case where the width of the edge guide auxiliary water flow-down surface (23) is 7 mm or less, the curtain film (6) sometimes comes into contact with edges of the edge guide auxiliary water flow-down surface (23) with respect to the width direction. As described above, when the internal structure of the edge guide shown in FIG. 8 is employed, the ejection velocity at the slit (11) can be freely set, and a result of research involved in the present invention has revealed that the fall velocity of both edges of the curtain film (6) supported by the edge guide main body (2) can be freely set.

In a conventional method, auxiliary water is ejected substantially uniformly from an upper portion toward a lower portion of an edge guide auxiliary water flow-down surface. A result of research involved in the present invention has revealed that, in this case, the fall velocity of a curtain film in the vicinity of each edge guide is smaller than that of a freely falling curtain film by approximately 30% at most.

In a conventional method, from fine pores of porous glass, auxiliary water is ejected at a velocity of approximately 0.5 cm/sec to approximately 2.0 cm/sec (ejection amount: 50 cc/min to 200 cc/min, edge guide height: 150 mm), which is low in comparison with a fall velocity of approximately 1.6 m/sec at a central portion with respect to the curtain width direction (fall height: 150 mm), and a curtain film is mixed with the auxiliary water that has been ejected from an upper portion and accelerated by gravity and that is falling at an increased velocity, which is thought to be a cause of formation of a thin film portion.

Employment of the edge guide of the present invention makes it possible to freely set the flow-down ejection velocity of the edge guide auxiliary water in the range of 40 cm/sec to 120 cm/sec. Thus, in comparison with the thickness of the freely falling curtain film at the central position with respect to the width direction, the thickness of the thin film portion in the vicinity of each edge guide can be made sufficiently large. Also, the thickness of the thin film portion can be controlled by changing the ejection velocity.

This makes it possible to, irrespective of the development of the boundary layer, control the fall velocity of the curtain film in the vicinity of each edge guide and reduce decrease in the thickness of the curtain film.

As a result of research involved in the present invention, it is possible to reduce increase in the thickness of the curtain film as well.

It is inferred that increase in the thickness of the curtain film can be reduced at the same time by setting the flow-down ejection velocity of the edge guide auxiliary water in the range of 40 cm/sec to 120 cm/sec as described above, which negates any relationship between the fall velocity of the curtain film in the vicinity of each edge guide and the boundary layer and which thereby reduces a liquid flow related to a surface tension gradient on the curtain film surface that causes decrease in the thickness of the curtain film. However, since the mechanism for increase in the film thickness has been unclear as yet, it is impossible to clearly explain the mechanism for reducing increase in the film thickness at this moment in time.

The following explains a second embodiment of the present invention in detail.

(Curtain Coating Apparatus and Curtain Coating Method)

A curtain coating apparatus of the present invention is intended for web coating and includes an ejecting unit, a pair of guiding units and a conveying unit. If necessary, the curtain coating apparatus may further include suitably selected other unit(s).

A curtain coating method of the present invention is intended for web coating and includes an ejecting step, a guiding step and a conveying step. If necessary, the curtain coating method may further include suitably selected other step(s).

<Ejecting Unit and Ejecting Step>

The ejecting unit is a unit having a coating liquid ejection port, configured to eject a coating liquid from the coating liquid ejection port. The ejecting step is a step of ejecting a coating liquid from a slit.

—Coating Liquid—

The coating liquid is not particularly limited and may be suitably selected according to the intended purpose. Examples thereof include acrylic emulsions, heat-sensitive liquids, thermal transfer ribbon coating liquids, aqueous coating liquids and solvent coating liquids.

Regarding the viscosity of the coating liquid, the appropriate viscosity range varies depending upon whether a slot die curtain coating apparatus or a slide die curtain coating apparatus is used as the curtain coating apparatus. Also, in the curtain coating method, the viscosity of the coating liquid needs to be adjusted to the appropriate viscosity range.

The appropriate viscosity range is not particularly limited and may be suitably selected according to the intended purpose. In the case of a slot die curtain coating apparatus, the coating liquid preferably has a low-shear viscosity of 1 mPa·s to 2,000 mPa·s. In the case of a slide die curtain coating apparatus, the coating liquid preferably has a viscosity of 1 mPa·s to 500 mPa·s. In the case of a coating liquid which has a property value showing that its viscosity decreases by shearing, its viscosity is preferably in the above-mentioned low-shear viscosity range.

Regarding the slot die curtain coating apparatus, when the viscosity of the coating liquid is low, liquid drips from slits of the die in the case where coating is temporarily ceased for adjustment or the like during an operation. When the viscosity of the coating liquid is greater than 2,000 mPa·s, (1) air bubbles in the liquid are hard to remove, thereby possibly causing a bubble-related defect caused by the air bubbles in the liquid, and (2) the ejection pressure of the coating liquid increases, so that there is a higher load on a liquid-sending pump and the liquid supply system needs pressure resistance. In the case of the slide die curtain coating apparatus, the viscosity of the coating liquid is preferably low in view of film thickness uniformity. When the viscosity of the coating liquid is high, the coating liquid flows slowly in the vicinity of a slide portion edge guide (denoted by the numeral 109 in FIG. 12) while flowing down a slide portion, and a boundary layer is formed as mentioned above, so that the coating liquid has an increased film thickness portion owing to viscous resistance while flowing down the slide portion. When the viscosity of the coating liquid is greater than 500 mPa·s, the coating liquid has a film thickness increased by over 20% in the area apart from the edge by 10 mm to 40 mm, compared to the coating liquid at the central flat portion, owing to the film thickness increasing mechanism while the coating liquid flows down the slide portion, and thus there arises a defect related to the unevenness of the film thickness, which leads to winding failure and/or drying failure.

The viscosity can be measured using a B-type viscometer or the like, for example.

The surface tension of the coating liquid is not particularly limited and may be suitably selected according to the intended purpose. Nevertheless, it is preferably in the range of 20 mN/m to 40 mN/m.

When the surface tension is less than 20 mN/m, the surface tension of the film itself is low, so that the film is slack and thus the film easily deforms and shakes owing to wind-based disturbance. When the surface tension is greater than 40 mN/m, the curtain film deforms in an upward direction.

The surface tension can be measured as a static surface tension in a platinum plate method, using a Face automatic surface tensiometer (manufactured by Kyowa Interface Science Co., Ltd) or the like, for example. Also, as described in "A study of the behavior of a thin sheet of moving liquid J. Fluid Mechanics, 10:297-305", the dynamic surface tension of the curtain film can be measured by means of the split angle of the film obtained by inserting needle-like foreign matter into the curtain film.

Regarding the mechanism of the deformation of the curtain film in an upward direction, the deformation is caused depending upon the balance between the dynamic pressure and the dynamic surface tension of the curtain film, and so it is important to measure and evaluate the dynamic surface tension of the film.

—Coating Liquid Slit—

The coating liquid slit is rectangular in cross-sectional shape.

The size of the coating liquid ejection port is not particularly limited and may be suitably selected according to the intended purpose. Nevertheless, the slit preferably has a gap of approximately 0.2 mm to approximately 0.5 mm.

The gap of the slit has a function of making uniform the coating liquid with respect to the width direction. The size of the gap varies depending upon the size and shape of a die manifold, the distance between the manifold and the outlet of the slit, the presence or absence of a second manifold, the position of the second manifold, the flow rate and viscosity of the coating liquid, and the like, as described in "Slot Coating: Fluid mechanics and die design, Sartor, Luigi, Ph.D. University of Minnesota, 1990", etc.

The material for the coating liquid ejection port is not particularly limited and may be suitably selected according to the intended purpose. The coating liquid ejection port preferably has a metal surface such as of SUS, aluminum or plating such as hard chromium plating.

The material is preferably a metal because clogging can be prevented even if the coating liquid contains resin.

—Ejection Mechanism—

An ejection mechanism for ejecting the coating liquid may be a slot die curtain coating apparatus or a slide die curtain coating apparatus, and the ejection mechanism is suitably selected from these according to the intended use.

The slot die curtain coating apparatus is used to apply one or two layers of coating liquid(s). The slot die curtain coating apparatus has a slit which faces downward, so that when the viscosity of the coating liquid is low, liquid dripping may arise and air bubbles in the liquid may remain in a manifold of a die head. Nevertheless, the slot die curtain coating apparatus is higher in the ejection velocity of the coating liquid than the slide die curtain coating apparatus; therefore, in view of the mechanism in which the curtain film deforms in an upward direction when there is great dynamic surface tension, which is related to the balance between the dynamic surface tension of the coating liquid and the dynamic pressure (inertial force) at the time of the fall of the coating liquid, the coating liquid used with the slot die curtain coating apparatus does not easily deform in an upward direction. Also, a releasing space such as a slide flow-down surface is not provided, so that washing can be facilitated and the amount of washing liquid used for the washing (such as water) is small. In case the viscosity of the coating liquid is high, coating can be temporarily ceased with ease during an operation.

The slide die curtain coating apparatus is used to apply one or more layers (possibly three or more layers) of coating liquid(s). The slide die curtain coating apparatus has a slit which faces upward, so that bubbles do not easily accumulate in a manifold of a die head. However, the area of a slide portion is large, washing is not easy, and a large amount of washing liquid is required at the time of a cessation of coating during an operation in comparison with the slot die curtain coating apparatus.

—Flow Rate of Coating Liquid—

The flow rate of the coating liquid ejected is not particularly limited as long as the curtain film can be formed, and the flow rate may be suitably selected according to the intended purpose.

The slot die curtain coating apparatus is not problematic as long as the coating liquid is ejected at an intended flow rate and the apparatus has portions in the forms of the slit and the manifold that are capable of forming the curtain film.

The slide die curtain coating apparatus is not problematic as long as it has portions in the forms of the slit and the manifold that enable the coating liquid to be ejected at an intended flow rate, and (after the coating liquid is ejected from the slit and then flows down a slide surface) the curtain film can be formed. However, when the flow rate of the coating liquid is relatively great, an upper portion of the curtain film has an increased film thickness portion, so that it is necessary to appropriately set the width (shown by the letter W in FIG. 16) of a groove of the edge guide, at the upper portion of the edge guide, according to the flow rate.

<Guiding Unit and Guiding Step>

Figure 15:
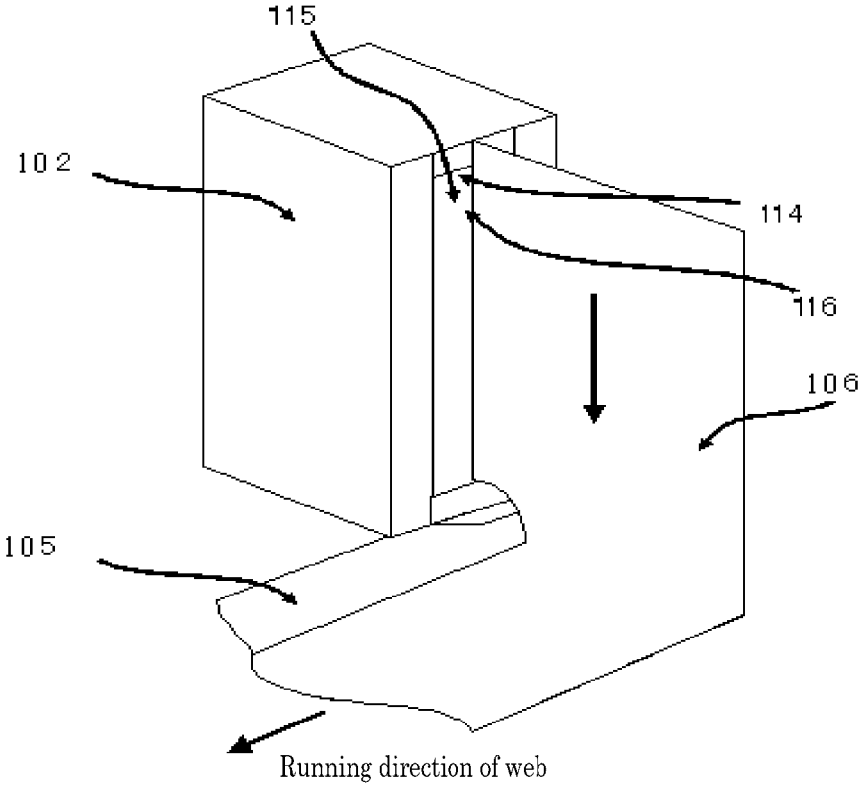
FIG. 15 is a drawing for explaining an example of an edge guide (guiding unit) in a curtain coating apparatus of the present invention.

As shown in FIG. 15, the guiding unit is a unit (102) including an auxiliary water introduction port (114) through which auxiliary water is introduced, configured to support both edges of a curtain film with respect to a width direction substantially perpendicular to the direction in which a curtain film (106) formed of the coating liquid flows down (direction of the arrow in FIG. 15), and guide the curtain film (106) onto a support (105) conveyed. The guiding step is a step of supporting both edges of a curtain film with respect to a width direction substantially perpendicular to the direction in which the curtain film (106) formed of the coating liquid flows down (direction of the arrow in FIG. 15), and guiding the curtain film (106) onto the support (105) conveyed, by using the pair of guiding units (102) each having the auxiliary water introduction port (114) through which auxiliary water is introduced.

Figure 16:
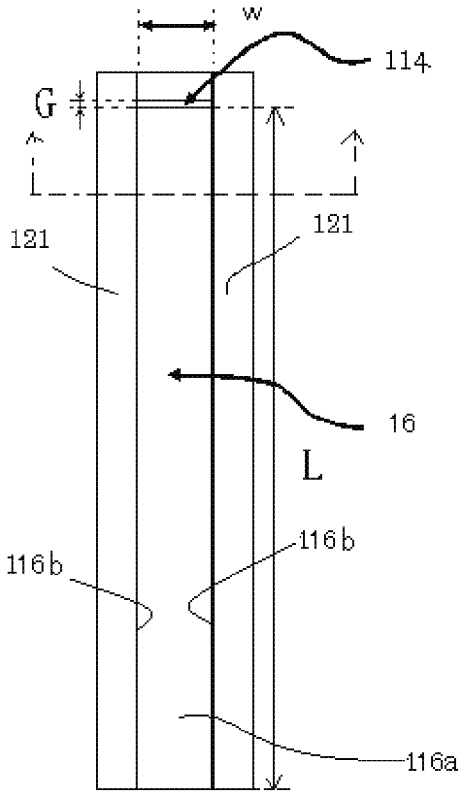
FIG. 16 is a front elevational view showing an example of an edge guide (guiding unit) in a curtain coating apparatus of the present invention.
Figure 19:
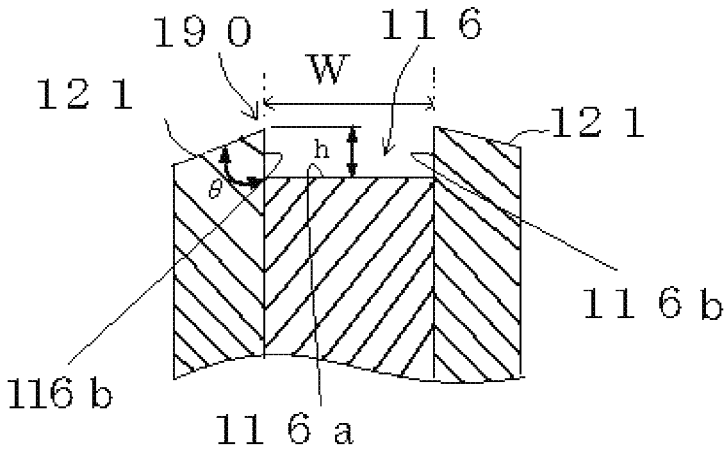
FIG. 19 is a cross-sectional view showing an example of an edge guide (guiding unit) in a curtain coating apparatus of the present invention.

As shown in FIGS. 16 and 19, the guiding unit includes an auxiliary water flow-down groove (concave portion) (116) through which the auxiliary water flows down. An auxiliary water flow-down groove side surface (concave portion side surface) (116*b*) formed substantially perpendicularly to a bottom surface (116*a*) of the auxiliary water flow-down groove (concave portion) (116) forms an acute angle θ with an exposed surface (121) formed so as to be continuous with the auxiliary water flow-down groove side surface (concave portion side surface) (116*b*) and intersect the auxiliary water flow-down groove side surface (concave portion side surface) (116*b*).

Figure 22:
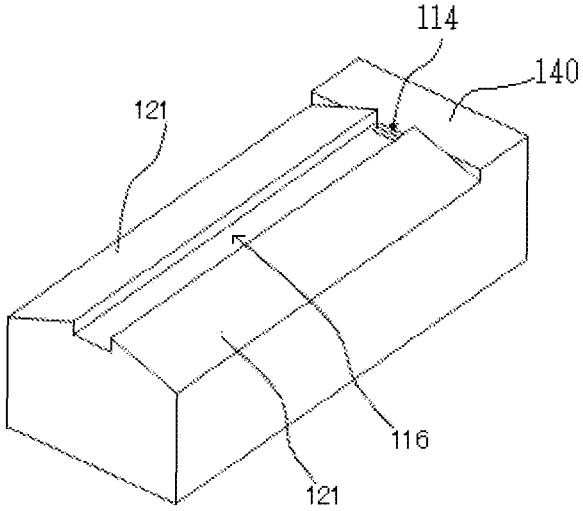
FIG. 22 is a perspective view showing an example of an edge guide (guiding unit) in a curtain coating apparatus of the present invention.
Figure 23:
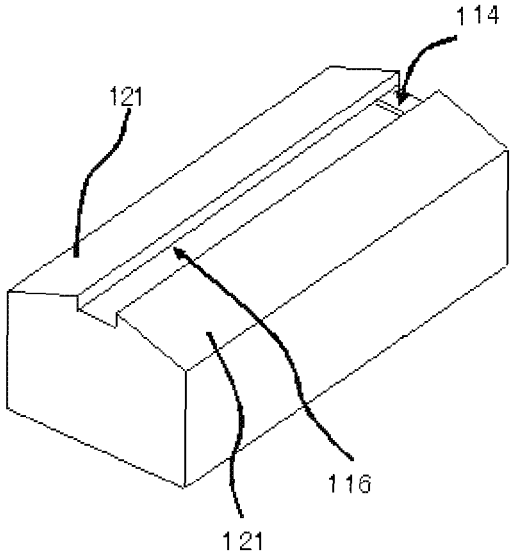
FIG. 23 is a perspective view showing another example of an edge guide (guiding unit) in a curtain coating apparatus of the present invention.

As shown in FIG. 22, each guiding unit preferably has a flat surface (140) (which measures 5 mm to 15 mm long and 7 mm or more wide) above the auxiliary water introduction port (114) with respect to the direction in which the auxiliary water flows down. With this flat surface (140), it is possible to avoid curving of the curtain film caused by the difference in velocity between the curtain film at a slide surface and the curtain film at a free surface (the teapot effect).

—Auxiliary Water (Edge Guide Water, Auxiliary Liquid)—

It is necessary to appropriately select the auxiliary water according to the coating liquid. It is necessary for the auxiliary water to be higher in surface tension than the coating liquid in order to exhibit an effect of holding the curtain film on the edge guide (so called center adjustability) by the auxiliary water pulling the coating liquid. Examples of the auxiliary water include aqueous liquids such as water, and (in the case where the coating liquid is a solvent-like substance) a liquid prepared by mixing together a solvent, water, a resin, a surfactant, etc.

—Auxiliary Water Introduction Port—

Regarding the auxiliary water introduction port, the maximum gap of the auxiliary water introduction port (shown by the letter G in FIG. 16) with respect to the direction in which the auxiliary water flows down is not particularly limited and may be suitably selected according to the intended purpose. Nevertheless, it is preferably in the range of 0.2 mm to 0.5 mm, more preferably 0.2 mm to 0.4 mm.

When the maximum gap is smaller than 0.2 mm, cleaning in the introduction port is not easy. When the maximum gap is larger than 0.5 mm, the ejection uniformity of the auxiliary water may be impaired.

The maximum width of the auxiliary water introduction port (shown by the letter W in FIG. 16) with respect to a direction perpendicular to the direction in which the auxiliary water flows down is not particularly limited and may be suitably selected according to the intended purpose. Nevertheless, it is preferably in the range of 1.5 mm to 4 mm, more preferably 2 mm to 3 mm.

When the maximum width is smaller than 1.5 mm, there may be a problem with processing accuracy. When the maximum width is larger than 4 mm, the auxiliary water may not uniformly flow with respect to the entire width.

The introduction rate of the auxiliary water is not particularly limited as long as the auxiliary water flows along the flow-down surface, and the introduction rate may be suitably selected according to the intended purpose. Nevertheless, it is preferably in the range of 0.4 m/sec to 2.1 m/sec, more preferably 0.8 m/sec to 1.6 m/sec.

When the introduction rate is lower than 0.4 m/sec, there may be a boundary layer formed. When the introduction rate is higher than 2.1 m/sec, the auxiliary water may be introduced diagonally and downward.

In the case (second embodiment) where the auxiliary water flow-down surface has an auxiliary water flow-down groove (concave portion), the auxiliary water flow-down surface is small in width and there are wall surfaces on both its sides, so that the auxiliary water can be favorably held and the fall velocity of the auxiliary water can be increased, in comparison with the case (first embodiment) where the auxiliary water flow-down surface has an arc-ended convex shape.

Also, since the flow-down surface is small in width, the auxiliary water can be made to flow down uniformly with respect to the entire width of the flow-down surface. Provided that the introduction rate of the auxiliary water does not vary, the amount of the ejected auxiliary water can be reduced because of the small width of the flow-down surface.

The auxiliary water introduction port is in the form of a slit which is rectangular in cross-sectional shape. It is preferred that the flow path in the edge guide be in the form of a long slit. However, in the case where the slit is long, cleaning becomes difficult if clogging arises; also, in reality, it is difficult to provide a long slit on the inside from a structural point of view.

Figure 17:
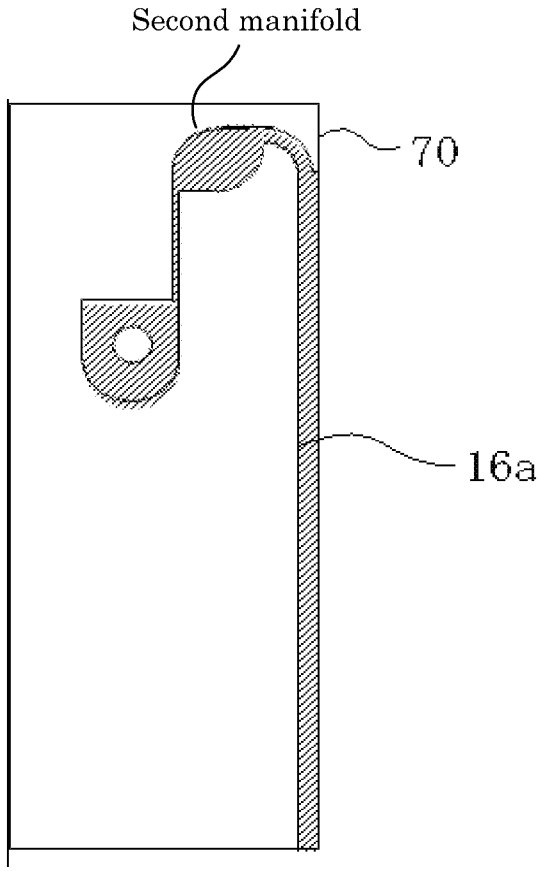
FIG. 17 is a drawing showing an example of an internal structure of an edge guide (guiding unit) in a curtain coating apparatus of the present invention.

Accordingly, it is preferable to provide a manifold on the inside of the edge guide, as shown in FIG. 17. Also, as shown in FIG. 17, the provision of a second manifold makes it possible for the auxiliary water to move a shorter distance to reach the auxiliary water introduction port, thereby making it possible to eject the auxiliary water uniformly.

The material for the auxiliary water introduction port is not particularly limited and may be suitably selected according to the intended purpose. Nevertheless, the material is preferably a metal because clogging can be prevented even if the coating liquid contains resin.

—Auxiliary Water Flow-Down Groove (Concave Portion)—

The auxiliary water flow-down groove (concave portion) includes a bottom surface, and a concave portion side surface formed substantially perpendicularly to the bottom surface.

The concave portion side surface forms an acute angle with an exposed surface formed so as to be continuous with the concave portion side surface and intersect the concave portion side surface.

The acute angle is not particularly limited as long as it is smaller than 90°, and it may be suitably selected according to the intended purpose. Nevertheless, it is preferably in the range of 30° to 80°, more preferably 45° to 60°.

When the acute angle is smaller than 30°, there may be adverse effects in terms of processing accuracy. When the acute angle is larger than 80°, the effects of the acute angle may be impaired. Conversely, when the acute angle is in the more preferred range, there is an advantage in that the edge guide auxiliary water can be favorably held.

The maximum depth of the auxiliary water flow-down groove (concave portion) (shown by the letter h in FIG. 19) is not particularly limited and may be suitably selected according to the intended purpose. Nevertheless, it is preferably in the range of 0.2 mm to 0.5 mm, more preferably 0.2 mm to 0.35 mm.

When the maximum depth is less than 0.2 mm, the auxiliary water may overflow the auxiliary water flow-down groove (concave portion). When the maximum depth is greater than 0.5 mm, turbulent flow may arise.

The maximum distance between the auxiliary water flow-down groove side surface (concave portion side surface) and the other auxiliary water flow-down groove side surface (concave portion side surface) (the maximum width W of the auxiliary water flow-down groove (concave portion), shown in FIG. 19) is not particularly limited and may be suitably selected according to the intended purpose. Nevertheless, it is preferably in the range of 1.5 mm to 4.0 mm, more preferably 2 mm to 3 mm.

When the maximum distance is less than 1.5 mm, the auxiliary water may flow with difficulty and overflow the concave portion. When the maximum distance is greater than 4.0 mm, the curtain film may be unstable, and turbulent flow may arise at the lower portion.

Regarding the slide die curtain coating apparatus, when the flow rate of the coating liquid is great and when, at the upper portion of the edge guide, the curtain film thickness is greater than the maximum width (W) of the groove, it is necessary to set the groove width (W) appropriately.

—Support—

The support is not particularly limited as long as it can support the coating liquid, and it may be suitably selected according to the intended purpose.

The shape, structure and size of the support are not particularly limited and may be suitably selected according to the intended purpose.

Examples of the support include release paper, base paper, synthetic paper and PET film.

<Conveying Unit and Conveying Step>

The conveying unit is a unit configured to convey the support. The conveying step is a step of conveying the support.

The following explains the curtain coating apparatus and the curtain coating method of the present invention in further detail, referring to the drawings.

The embodiments described below are those suitable for the present invention and involve various technically preferred limitations.

It should be noted that the present invention is not confined to these embodiments unless otherwise stated.

Figure 12:
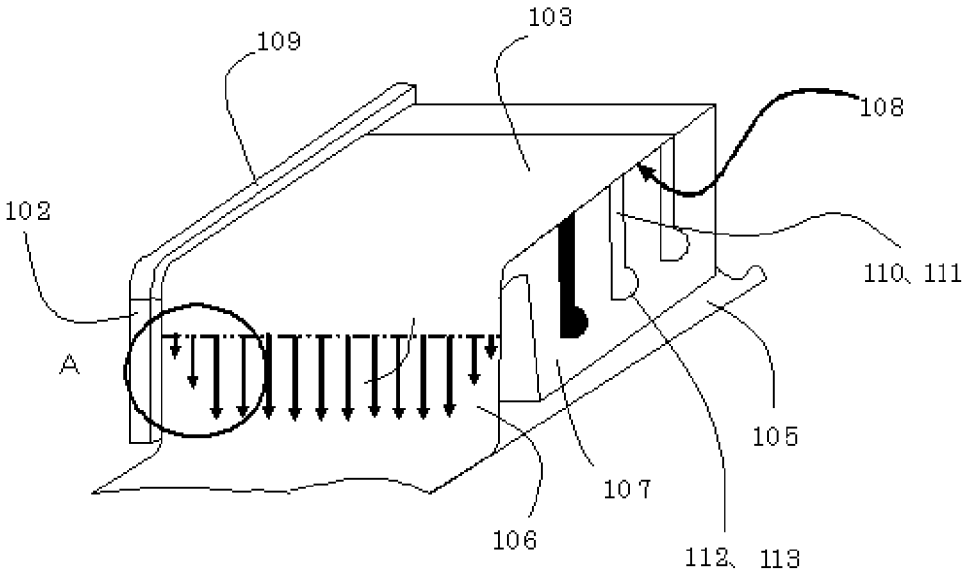
FIG. 12 is a schematic drawing showing an example of a slide curtain coating apparatus of the present invention.

FIG. 12 shows an example of a slide curtain coating apparatus as a curtain coating apparatus of the present invention.

In FIG. 12, a slide curtain coating apparatus (curtain coating head) (107) includes slots (110) and (111), manifolds (112) and (113) and slits (not shown), provided as ejecting units configured to eject a coating liquid (103). These ejecting units eject the coating liquid (103) onto a slide surface (108), the coating liquid (103) flows on the slide surface (108) and then freely falls from the slide surface (108) so as to form a curtain film (106) and then form a coating film on a continuously running web (base material) (105). On this occasion, the web (105) is conveyed by means of a conveying unit (not shown). At sides of the slide surface (108) is provided a slide portion edge guide (guiding unit) (109), and at sides of the curtain film (106) is provided a curtain portion edge guide (guiding unit) (102) configured to hold each edge of the curtain film (106).

In the case of multilayer simultaneous coating, a slide curtain coating apparatus (curtain coating head) (107) has a plurality of manifolds (112) and (113) and a plurality of slots (110) and (111). The plurality of manifolds (112) and (113) and the plurality of slots (110) and (111) allow a coating liquid (103) to be ejected onto a slide surface (108), and the coating liquid (103) is layered on the slide surface (108). The layered coating liquid (103) freely falls from the slide surface (108) so as to form a curtain film (106) and then form a coating film on a continuously running web (base material) (105).

Figure 13:
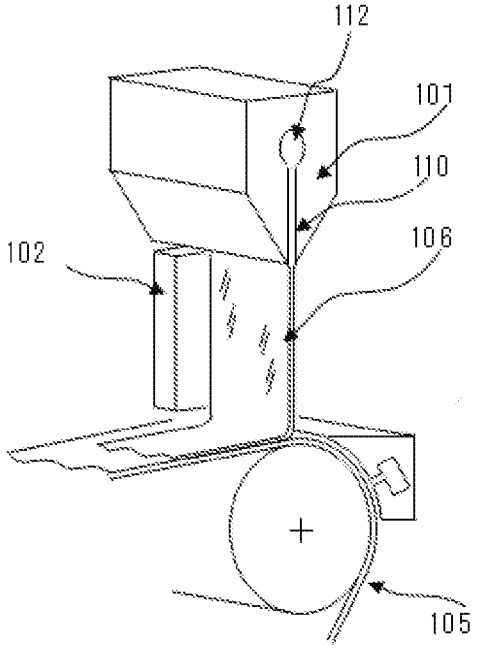
FIG. 13 is a schematic drawing showing an example of a slot curtain coating apparatus of the present invention.

FIG. 13 is a drawing showing an example of a slot curtain coating apparatus as a curtain coating apparatus of the present invention.

In FIG. 13, a coating liquid is ejected from a manifold (112) and a slot (110) provided in a slot curtain coating head (101), and the coating liquid flows down as a curtain film (106), with its each edge held by an edge guide (102), then comes into collision with a base material (105) and is thus applied to the base material (105).

Figure 14:
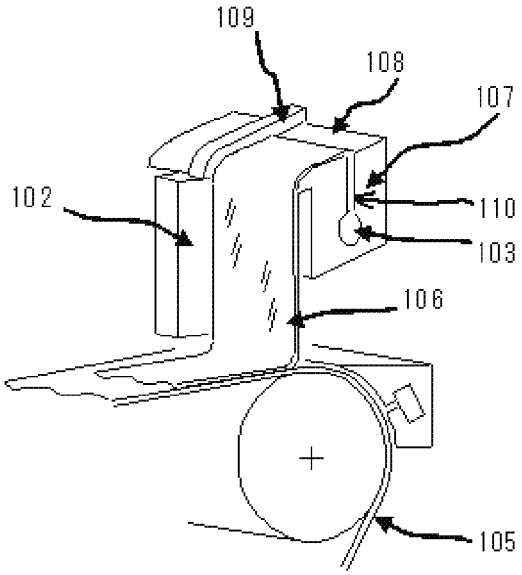
FIG. 14 is a schematic drawing showing another example of a slot curtain coating apparatus of the present invention.

Meanwhile, as shown in FIG. 14, a coating liquid is ejected from a manifold (113), a slot (110) and a slit (not shown) provided in a slide curtain coating head (107), and the coating liquid flows on a slide surface (108), subsequently flows down with its each edge held by an edge guide main body (102), then comes into collision with a base material (105) and is thus applied to the base material (105).

In the case of multilayer simultaneous coating, a plurality of manifolds (113), slots (110) and slits (not shown) are provided, a coating liquid is ejected onto a slide surface (108), and the coating liquid is layered on the slide surface (108). The layered coating liquid freely falls from the slide surface (108) so as to form a curtain film (106) and then form a coating film on a continuously running web (105).

As shown in FIG. 15, an edge guide main body (102) has at its upper portion an auxiliary water introduction port (114) which allows auxiliary water (115) to be ejected in a downward direction and substantially uniformly with respect to the width direction of an auxiliary water flow-down groove (concave portion) (116).

The auxiliary water introduction port (114) is rectangular in cross-sectional shape and is placed perpendicularly to a curtain film (106) and perpendicularly to the direction in which the curtain film (106) falls down.

The curtain film (106) falls in the direction of the arrow, and both its edges are supported by the auxiliary water (115) which falls inside the auxiliary water flow-down groove (concave portion) (116) of the edge guide main body (102).

The introduction rate of the auxiliary water (115) is set by changing the opening degree of a flow rate adjusting valve (not shown) or changing the ejection amount of a pump.

At a lower portion of the edge guide main body (102), a discharge port (not shown) which allows a mixed liquid composed of the auxiliary water (115) and a coating liquid to discharge, and a vacuum mechanism (not shown) which makes it easy for the mixed liquid to discharge are provided. Also at the lower portion of the edge guide main body (102), auxiliary water for preventing adhesion of the coating liquid may be applied.

FIG. 16 is a front elevational view of an edge guide main body (102), and FIG. 19 is a cross-sectional view of the edge guide main body (102). As shown in FIG. 19, the letter W denotes the maximum distance between a concave portion side surface (116*b*) and the other concave portion side surface (116*b*) of the edge guide main body (102) (the maximum width of an auxiliary water flow-down groove (concave portion) (116), the maximum width of an auxiliary water introduction port (114)), and the letter h denotes the maximum depth of the auxiliary water flow-down groove (concave portion) (116). An end (190) has an acute angle θ. Additionally, the end may have a flat portion of approximately 0.1 mm in size in view of processing accuracy or have a curved surface (R) of approximately several tens of micrometers to 100 μm in size so as to reduce the amount of a burr or flash.

Meanwhile, as shown in FIG. 17, the gap of an auxiliary water introduction port (114) is adjusted to 0.2 mm, and there is a level difference provided such that the distance of a bottom surface (116*a*) of an auxiliary water flow-down groove (concave portion) (116) from a curtain film and a joint surface (170) at an upper portion of an edge guide is in the approximate range of 0.2 mm to 0.5 mm.

A manifold is provided in at least one place inside the edge guide, thereby allowing auxiliary water to be ejected uniformly with respect to the width direction. The bottom surface of the auxiliary water flow-down groove of the edge guide is preferably a metal surface such as of SUS, aluminum or plating such as hard chromium plating. Other parts thereof may be made of hydrophilic material or hydrophobic material.

Also, the edge guide (guiding unit) can be applied to both slide curtain coating apparatuses (as shown in FIG. 12) and slot curtain coating apparatuses (as shown in FIGS. 13 and 14).

When the bottom surface and the side surfaces of the auxiliary water flow-down groove are made of metal instead of porous material, the problem of clogging of the porous material with a coating liquid can be solved, and center adjustability can be exhibited by the surface tension of the auxiliary water, not by the surface tension of the coating liquid. Therefore, by providing the auxiliary water flow-down groove (concave portion), it is possible to form a curtain film which is stable against wind-based disturbance. Also, by introducing the auxiliary water in the falling direction of the curtain film and along edges of the curtain film at an initial introduction rate of 0.4 m/sec to 1.6 m/sec, it is possible to further suppress formation of a boundary layer in the curtain film.

However, there is a case where the auxiliary water does not flow through the entire surface at a lower portion of the auxiliary water flow-down groove (concave portion) but flows in the form of a string, thereby causing instability of the curtain film, and there is a case where turbulent flow arises at a lower portion of the edge guide. It has been found that these phenomena stem from the maximum width W of the auxiliary water flow-down groove.

Although details of the mechanism for the occurrence of the turbulent flow are unknown, the following has been found. As shown in 24, the flow of auxiliary water (115) which is in contact with a curtain film (106) is turbulent flow at a lower portion of an edge guide, and thus the curtain film is disturbed. The case where the flow of the auxiliary water is turbulent flow can be easily identified because the auxiliary water shakes violently together with the curtain film which is in contact with the auxiliary water. Meanwhile, there is a case where the auxiliary water stably flows as laminar flow. Since turbulent flow easily arises at the lower portion of the edge guide (in the case of high velocity), it is thought that the occurrence of the turbulent flow is deeply related to the Reynolds number in the flow path of the auxiliary water, and that the occurrence is therefore related to the maximum depth h of the auxiliary water flow-down groove (concave portion) and the maximum width W of the auxiliary water flow-down groove that influence the Reynolds number.

The edge guide in the present invention can be applied to both slide curtain coating apparatuses (as shown in FIG. 12) and slot curtain coating apparatuses (as shown in FIGS. 13 and 14). It should, however, be noted that in the case where the edge guide in the present invention is applied to a slide curtain coating apparatus, it is necessary to avoid curving of the curtain film caused by the difference in velocity between the curtain film at the slide surface (108) and the curtain film at the free surface (the teapot effect), when the coating liquid has flowed on the slide surface (108) and forms a freely falling liquid film.

Accordingly, a width of at least 3 mm is required alongside the auxiliary water introduction port and ahead of the curtain film, and a width of at least 1 mm is required alongside the auxiliary water introduction port and behind the curtain film, which means that a total width of at least 7 mm (the sum of the above-mentioned widths and the width (3 mm) of the auxiliary water introduction port) is required. As for the height direction, a length of at least 5 mm is required above the auxiliary water introduction port, and (depending upon the flow rate of the coating liquid) a length of approximately 5 mm to approximately 15 mm is required above the auxiliary water introduction port.

Therefore, as shown in FIG. 22, a flat surface which measures 5 mm to 15 mm long and 7 mm or more wide is preferably formed at the upper portion of the edge guide, extending from the lower edge of the slide curtain die. Although a metal surface is employed as this flat surface, a hydrophilic or hydrophobic surface may be employed. Also, the auxiliary water may be applied onto the flat surface.

It is necessary for the auxiliary water introduction port (114) to be in the shape of a straight line (slit) which is perpendicular to the width direction of the curtain film (106) and perpendicular to the falling direction of the curtain film (106).

EXAMPLES

The following explains the present invention referring to Examples. It should, however, be noted that the present invention is not confined to these Examples. The term "part(s)" and the sign "%" mean "part(s) by mass" and "% by mass" respectively, unless otherwise stated.

Example A-1

Fundamental Conditions for Experiment

Coating apparatus: the apparatus shown in FIG. 2

Curtain fall width: 250 mm

The position of the edge guide can be shifted back and forth in a base material traveling direction. The curtain falling position was adjusted such that the curtain fell down at the center of the edge guide auxiliary water flow-down surface with respect to the width direction.

Coating liquid: acrylic emulsion adhesive having a liquid viscosity of 750 mPa·s (B-type viscometer), a liquid surface tension of 33 mN/m (static surface tension in a platinum plate method) and a flow rate of 1.25 cc/cm·sec Edge guide auxiliary water: 0.40 m/sec in introduction rate (100 cc/min per 6.5 mm as a width of the edge guide auxiliary water flow-down surface), 0.35 mm as the size of the gap for the auxiliary water inlet Presence or absence of distortion of the curtain film at the edge guide caused by the teapot effect Presence or absence of variation in the falling position of the curtain film at the edge guide caused by disturbance wind As the disturbance wind, a wind was blown at a wind velocity of 3 m/sec (measured with ANEMOMASTER) to the curtain film, using a compact blower.

The edge guide shown in FIG. 2 was used.

L=33 mm

R (shown in FIG. 5)=5 mm

θ1=60 degrees

θ2=90 degrees

Width W of the edge guide auxiliary water flow-down surface=14 mm

Material for the edge guide: SUS402J2

The edge guide auxiliary water flow-down surface and side plates at both ends of the edge guide auxiliary water flow-down surface were polished in the flow-down direction of the edge guide auxiliary water, using sandpaper (#1500).

Comparative Example A-1

Comparative Example A-1 was the same as Example A-1 except that the flat plate edge guide (in which a slide portion is formed of an SUS plate instead of glass) mentioned in JP-A No. 2001-46939 was used.

Width W of the edge guide auxiliary water flow-down surface=14 mm

Material for the edge guide: SUS402J2

The edge guide auxiliary water flow-down surface and side plates at both ends of the edge guide auxiliary water flow-down surface were polished in the flow-down direction of the edge guide auxiliary water, using sandpaper (#1500).

Comparative Example A-2

Comparative Example A-2 was the same as Example A-1 except that the edge guide (manufactured by Polytype Ltd. in Switzerland) mentioned in International Publication No. WO2008/000507 was used.

Curvature radius of the arc-ended convex shape on the edge guide auxiliary water flow-down surface: 5.5 mm Width of the edge guide auxiliary water flow-down surface=6.5 mm.

TABLE 1

| | Presence or absence of distortion of curtain film caused by teapot effect | Presence or absence of variation in falling position of curtain film caused by disturbance wind |
|---|---|---|
| Example A-1 | A: There was no distortion. The curtain film had a curved portion (approx. 5 mm in width and approx. 20 mm in fall down distance) owing to the teapot effect and subsequently had a perpendicular falling portion. | A: There was no positional variation. |
| Comparative Example A-1 | A: There was no distortion. The curtain film had a curved portion (approx. 5 mm in width and approx. 35 mm in fall down distance) owing to the teapot effect and subsequently had a perpendicular falling portion. | B: There was a great positional variation. The curtain film was trapped by the side plates at both ends of the edge guide auxiliary water flow-down surface and thus distorted. |
| Comparative Example A-2 | B: The curtain film had a curved portion (approx. 5 mm in width) owing to the teapot effect, slightly touched the side plates at both ends of the edge guide auxiliary water flow-down surface, and thus distorted. | A: There was no positional variation. |

To clarify effects derived from the length of R shown in FIG. 5, comparisons of center-adjusting performances were made, changing the edge guide and the length of R.

With the vertical direction of the edge guide being a reference direction, the curtain edge guide main body was tilted in the direction of a surface which was at right angles to the coating width direction.

Evaluation Criteria

A: 10 degrees or greater in tilt angle

B: 6 degrees or greater but less than 10 degrees in tilt angle

C: less than 6 degrees in tilt angle

| Coating liquid: thermosensitive layer liquid for thermal paper {solid content concentration (S.C.): 9.9%, viscosity: 250 mPa · s (B-type viscometer), liquid surface tension: 39 mN/m (static surface tension* in a platinum plate method); *the static surface tension was measured using the Face automatic surface tensiometer CBVP-A3 (manufactured by Kyowa Interface Science Co., Ltd)} | |
|---|---|
| 3-dibutylamino-6-methyl-7-anilinofluoran | 4 parts |
| 4-isopropoxy-4'-hydroxydiphenylsulfone | 12 parts |
| Silica | 6 parts |
| 10% aqueous solution of polyvinyl alcohol | 16 parts |
| Water | 41 parts |

Example A-2

Example A-2 was the same as Example A-1 except that the length of R was changed from 5 mm to 3 mm.

Example A-3

Example A-3 was the same as Example A-1 except that the length of R was changed from 5 mm to 2 mm.

Example A-4

Example A-4 was the same as Example A-1 except that the length of R was changed from 5 mm to 5.5 mm.

Example A-5

Example A-5 was the same as Example A-1 except that the length of R was changed from 5 mm to 1.5 mm.

TABLE 2

| | Tilt angle of curtain film held (°) | Evaluation |
|---|---|---|
| Example A-1 | 15 | A |
| Example A-2 | 18 | A |
| Example A-3 | 13 | A |

TABLE 2-continued

| | Tilt angle of curtain film held (°) | Evaluation |
|---|---|---|
| Example A-4 | 7 | B |
| Example A-5 | 8 | B |

Effects derived from the position of the apex of the inverted isosceles triangle, whose oblique sides connected the center line (with respect to the width direction) of the convex portion at the lower portion of the edge guide auxiliary water flow-down surface with both ends of the edge guide auxiliary water flow-down surface, were clarified.

The falling state of the curtain film at the edge guide was observed, and effects of the oblique sides of the isosceles triangle, in particular, were confirmed.

Evaluation Criteria

A: The curtain film fell perpendicularly along the apex of the arc-ended convex portion (the curtain film was allowed to be trapped at the oblique sides of the isosceles triangle for approximately 10 mm).

B: The curtain film fell vertically anywhere along the arc-ended convex portion.

D: The curtain film fell outside the arc-ended convex portion.

Example A-6

Example A-6 was the same as Example A-1 except that the position of the edge guide was shifted by 2 mm toward the upstream side with respect to the base material traveling direction.

Example A-7

Example A-7 was the same as Example A-1 except that the length of L was changed from 33 mm to 10 mm.

Example A-8

Example A-8 was the same as Example A-1 except that the length of L was changed from 33 mm to 5 mm.

Example A-9

Example A-9 was the same as Example A-1 except that the length of L was changed from 33 mm to 40 mm.

Example A-10

Example A-10 was the same as Example A-1 except that the length of L was changed from 33 mm to 145 mm.

When the length of L was 145 mm, the oblique sides of the inverted isosceles triangle, which connected the center line (with respect to the width direction) of the convex portion at the lower portion of the edge guide auxiliary water flow-down surface with both ends of the edge guide auxiliary water flow-down surface, extended approximately between the point that was 10 mm apart from the upper edge of the edge guide and the lower edge of the edge guide.

TABLE 3

| | Falling state of curtain film | Evaluation result |
|---|---|---|
| Example A-1 | The curtain film had a curved portion (approx. 5 mm in width and approx. 20 mm in fall down distance) owing to the teapot effect and subsequently had a perpendicular falling portion along the apex of the arc-ended convex portion. | A |

TABLE 3-continued

| | Falling state of curtain film | Evaluation result |
|---|---|---|
| Example A-6 | The curtain film had a curved portion, trapped at the oblique sides of the isosceles triangle for approx. 10 mm, owing to the teapot effect and subsequently had a perpendicular falling portion along the apex of the arc-ended convex portion. The curtain film was not abnormal. | A |
| Example A-7 | The curtain film had a curved portion, trapped at the oblique sides of the isosceles triangle for approx. several millimeters, owing to the teapot effect and subsequently had a perpendicular falling portion along the apex of the arc-ended convex portion. The curtain film was not abnormal. | A |
| Example A-8 | The curtain film had a curved portion (approx. 5 mm in width) owing to the teapot effect, and there was a case confirmed where the curtain film immediately fell outside the arc-ended convex portion. | B |
| Example A-9 | The curtain film had a curved portion (approx. 5 mm in width) owing to the teapot effect, and there were a case confirmed where the curtain film fell perpendicularly along the flat surface portion and then fell perpendicularly along the surfaces at the sides of the arc-ended convex portion, and a case confirmed where the curtain film fell in the vicinity of the apex of the arc-ended convex portion. | B |
| Example A-10 | The curtain film was trapped at the oblique sides of the isosceles triangle, and there was a case confirmed where the curtain film did not fall perpendicularly but fell diagonally. | B |

Effects derived from the ejection velocity of the edge guide auxiliary water were clarified.

The ejection velocity was calculated from the ejection flow rate and the cross-sectional area of the slit through which the edge guide auxiliary water was ejected.

The measurement was carried out at positions which were apart from the edge guide by 5 mm, 15 mm and 125 mm respectively.

Example A-11

Example A-11 was the same as Example A-1 except that the introduction rate of the auxiliary water was changed from 0.40 m/sec to 0.80 m/sec.

Example A-12

Example A-12 was the same as Example A-1 except that the introduction rate of the auxiliary water was changed from 0.40 m/sec to 1.20 m/sec.

Example A-13

Example A-13 was the same as Example A-1 except that the introduction rate of the auxiliary water was changed from 0.40 m/sec to 0.20 m/sec.

Example A-14

Example A-14 was the same as Example A-1 except that the introduction rate of the auxiliary water was changed from 0.40 m/sec to 1.60 m/sec.

Example A-15

Example A-15 was the same as Example A-1 except that the introduction rate of the auxiliary water was changed from 0.40 m/sec to 0.35 m/sec.

Example A-16

Example A-16 was the same as Example A-1 except that the introduction rate of the auxiliary water was changed from 0.40 m/sec to 1.25 m/sec.

<<Curtain Fall Velocity>>

The curtain fall velocity was measured at a position which was apart from the lower edge of the curtain die lip by 140 mm.

Measuring apparatus: MODEL 1110A, manufactured by ACT Electronics Corp.

Comparisons of relative velocities were made, as the fall velocity of the curtain film at the position which was apart from the edge guide by 125 mm was defined as 100%.

Evaluation Criteria

A: The relative velocity was 95% or greater.

B: The relative velocity was 90% or greater but less than 95%.

B: The relative velocity was less than 90%.

TABLE 4

| | Distance from edge guide | | | |
|---|---|---|---|---|
| | 5 mm | 15 mm | 125 mm | Evaluation |
| Example A-1 | 95.7% | 99.6% | 100.0% | A |
| Example A-11 | 99.7% | 99.8% | 100.0% | A |
| Example A-12 | 102.3% | 99.8% | 100.0% | A |
| Example A-15 | 94.2% | 99.7% | 100.0% | B |
| Example A-16 | 103.1% | 100.3% | 100.0% | A |
| Example A-13 | 94.5% | 100.7% | 100.0% | B |
| Example A-14 | 108.2% | 99.9% | 100.0% | A |
| Comparative Example A-2 | 88.6% | 98.8% | 100.0% | C |

The results in Table 4 demonstrate that there was no difference between Examples and Comparative Example in fall velocity at the position apart from the edge guide by 125 mm. It is inferred that this is because the fall of each curtain film depends upon gravity.

<<Curtain Film Thickness>>

The liquid amount of the curtain film was measured using a gutter of 4 mm in width, and the thickness of the curtain film was calculated from the fall velocity thereof by means of conversion.

Comparisons of relative film thicknesses were made, as the fall velocity of the curtain film at the position which was apart from the edge guide by 125 mm was defined as 100%.

The measurement was carried out at the position apart from the lower edge of the curtain die lip by 140 mm.

Evaluation Criteria

A: less than −20% at the position apart from the edge guide by 5 mm

B: −20% or more at the position apart from the edge guide by 5 mm

A: less than +10% at the position apart from the edge guide by 15 mm

B: +10% or more at the position apart from the edge guide by 15 mm

Further, an evaluation was made according to the stability of the curtain film and the presence or absence of unevenness of the curtain film, in addition to the foregoing evaluation criteria.

Reason why the evaluation criteria were set as mentioned above; findings hitherto obtained demonstrate that approximately the same curtain film thickness distribution as the curtain film thickness distribution measured at the position apart from the upper edge of the curtain film by 140 nm is measured on a base material, which leads to uniformity or unevenness of film thickness. Generally, when the coating film thickness uniformity is more than ±10%, there is a coating defect caused; accordingly, the evaluation was carried out with reference percentages being±10%.

Reason why the distances from the edge guide were set as mentioned above: the position apart from the edge guide by 5 mm was approximately the central position of a thin film portion where the film thickness was small, whereas the position apart from the edge guide by 15 mm was the position of the largest thickness in a thick film portion where the film thickness was large.

TABLE 5

| | Distance from edge guide | | | |
|---|---|---|---|---|
| | 5 mm | 15 mm | 125 mm | Evaluation |
| Example A-1 | 86% | 103% | 100% | A |
| Example A-11 | 81% | 102% | 100% | A |
| Example A-12 | 84% | 100% | 100% | A |
| Example A-13 | 85% There was a case where the curtain film was unstable. | 103% There was a case where the curtain film was unstable. | 100% | B |
| Example A-14 | 81% There was a case where the curtain film was uneven. | 98% There was a case where the curtain film was uneven. | 100% | B |
| Comparative Example A-2 | 69% | 120% | 100% | C |

TABLE 5-continued

| | Distance from edge guide | | | |
|---|---|---|---|---|
| | 5 mm | 15 mm | 125 mm | Evaluation |
| Example A-15 | 81% There was a case where the curtain film was unstable. | 104% There was a case where the curtain film was unstable. | 100% | B |
| Example A-16 | 82% There was a case where the curtain film was uneven. | 103% There was a case where the curtain film was uneven. | 100% | B |

Regarding Examples A-13 and A-15, there was a case where the curtain film tended to deform in an upward direction and was therefore unstable.

Regarding Examples A-14 and A-16, there were a case where the curtain film was uneven, and a case where the coating film was also uneven.

The ejection uniformity at the edge guide auxiliary water inlet and the flow down uniformity with respect to the width direction were evaluated changing the size of the gap for the edge guide auxiliary water inlet.

The edge guide auxiliary water was introduced at two introduction rates as shown below.

The edge guide auxiliary water introduction rates: 0.8 m/sec and 1.2 m/sec

Only the introduction uniformity of the auxiliary water at the edge guide auxiliary water inlet and the flow down state of the auxiliary water were visually observed without forming a curtain film.

Evaluation Criteria

A: The auxiliary water was introduced uniformly with respect to the entire width and flowed uniformly with respect to the entire flow-down surface.

B: The auxiliary water was introduced unevenly at the inlet or flowed unevenly along the flow-down surface.

C: The auxiliary water was introduced unevenly at the inlet and flowed unevenly along the flow-down surface.

Example A-17

Example A-17 was the same as Example A-1 except that the introduction rate of the auxiliary water was changed from 0.40 m/sec to 0.80 m/sec and the size of the gap for the edge guide auxiliary water inlet was changed from 0.35 mm to 0.2 mm.

Example A-18

Example A-18 was the same as Example A-1 except that the introduction rate of the auxiliary water was changed from 0.40 m/sec to 0.80 m/sec and the size of the gap for the edge guide auxiliary water inlet was changed from 0.35 mm to 0.5 mm.

Example A-19

Example A-19 was the same as Example A-1 except that the introduction rate of the auxiliary water was changed from 0.40 m/sec to 0.80 m/sec and the size of the gap for the edge guide auxiliary water inlet was changed from 0.35 mm to 0.1 mm.

Example A-20

Example A-20 was the same as Example A-1 except that the introduction rate of the auxiliary water was changed from 0.40 m/sec to 0.80 m/sec and the size of the gap for the edge guide auxiliary water inlet was changed from 0.35 mm to 0.6 mm.

Example A-21

Example A-21 was the same as Example A-1 except that the introduction rate of the auxiliary water was changed from 0.40 m/sec to 1.2 m/sec and the size of the gap for the edge guide auxiliary water inlet was changed from 0.35 mm to 0.2 mm.

Example A-22

Example A-22 was the same as Example A-1 except that the introduction rate of the auxiliary water was changed from 0.40 m/sec to 1.2 m/sec and the size of the gap for the edge guide auxiliary water inlet was changed from 0.35 mm to 0.5 mm.

Example A-23

Example A-23 was the same as Example A-1 except that the introduction rate of the auxiliary water was changed from 0.40 m/sec to 1.2 m/sec and the size of the gap for the edge guide auxiliary water inlet was changed from 0.35 mm to 0.1 mm.

Example A-24

Example A-24 was the same as Example A-1 except that the introduction rate of the auxiliary water was changed from 0.40 m/sec to 1.2 m/sec and the size of the gap for the edge guide auxiliary water inlet was changed from 0.35 mm to 0.6 mm.

Effects derived from the ejection velocity of auxiliary water were clarified. In the process of research into the effects, it was found that, depending upon the size of the gap of an introduction port, the auxiliary water did not flow down uniformly with respect to the width direction of the flow-down surface.

Also, effects which the size of the gap of the introduction port of the auxiliary water has on the uniformity of the downward flow of the auxiliary water with respect to the width direction of the flow-down surface were clarified.

In the case where the size of the gap of the introduction port was in the range of 0.2 mm to 0.5 mm, the auxiliary water flowed down substantially uniformly with respect to the entire width of the flow-down surface, at introduction rates of 0.8 m/sec and 1.2 m/sec. However, in Examples A-19 and A-23 where the size of the gap was 0.1 mm, the auxiliary water was not uniformly introduced from the introduction port, and there was a case where part of the auxiliary water flowed down diagonally, thereby causing the flow of the curtain film to distort.

Meanwhile, in Examples A-20 and A-24 where the size of the gap was 0.6 mm, there was a case where the auxiliary water did not flow down for the entire width of the flow-down surface and mixed with the curtain film, at a lower portion of the flow-down surface.

As described above, it was revealed that when the gap of the introduction port of the auxiliary water was in the range of 0.2 mm to 0.5 mm, the auxiliary water flowed down uniformly with respect to the width direction of the flow-down surface.

Example B-1

Curtain coating was carried out under the conditions below, using the slide die curtain coating apparatus shown in

TABLE 6

| | Ejection and flow down state of auxiliary water | Evaluation |
|---|---|---|
| Example A-17 | The edge guide auxiliary water was ejected uniformly with respect to the entire width and flowed down for almost the entire width of the flow-down surface. | A |
| Example A-18 | The edge guide auxiliary water was ejected uniformly with respect to the entire width and flowed down for almost the entire width of the flow-down surface. | A |
| Example A-19 | The edge guide auxiliary water was not uniformly ejected from the exit of the inlet, and there was a case where part of the auxiliary water flowed down diagonally, thereby causing the flow of the curtain film to distort. | B |
| Example A-20 | There was a case where the edge guide auxiliary water did not flow down for the entire width of the flow-down surface and mixed with the curtain film, at a lower portion of the flow-down surface. | B |

TABLE 7

| | Ejection and flow down state of auxiliary water | Evaluation |
|---|---|---|
| Example A-21 | The edge guide auxiliary water was ejected uniformly with respect to the entire width and flowed down for almost the entire width of the flow-down surface. | A |
| Example A-22 | The edge guide auxiliary water was ejected uniformly with respect to the entire width and flowed down for almost the entire width of the flow-down surface. | A |
| Example A-23 | The edge guide auxiliary water was not uniformly ejected from the exit of the inlet, and there was a case where part of the auxiliary water flowed down diagonally, thereby causing the flow of the curtain film to distort. | B |
| Example A-24 | There was a case where the edge guide auxiliary water did not flow down for the entire width of the flow-down surface and mixed with the curtain film, at a lower portion of the flow-down surface. | B |

FIG. 12, and the following were evaluated: (i) the stability of the curtain film against disturbance such as wind; (ii) the presence or absence of turbulent flow in the vicinity of the edge guide; (iii) the presence or absence of a phenomenon in which the edge guide auxiliary water did not flow on the entire surface (a phenomenon in which the auxiliary water flowed in the form of a string), and of turbulent flow at a lower portion of the edge guide; and (iv) the flow rate distribution of the curtain film with respect to the width direction. The evaluation results are shown in Tables 8 to 13.

Parenthetically, the position of the edge guide could be shifted, and the falling position of the curtain film was adjusted to one side of an end of the edge guide.

<Conditions for Curtain Coating>

(1) Coating Liquid

As the coating liquid, an acrylic emulsion adhesive (product name: X-407-102E-10, manufactured by SAIDEN CHEMICAL INDUSTRY CO., LTD.) was used.

The liquid viscosity of the coating liquid, measured using a B-type viscometer (product name: VISMETRON VS-A1, manufactured by SHIBAURA SYSTEMS CO., LTD.) with a No. 3 rotor at a rotational speed of 30 rpm, was 450 mPa·s. The liquid viscosity is expressed by a power law as $Y=900X^{-0.26}$.

The static surface tension (in a platinum plate method) of the coating liquid, measured using the Face automatic surface tensiometer CBVP-A3 (manufactured by Kyowa Interface Science Co., Ltd), was 33 mN/m.

(2) Flow Rate of Coating Liquid

The flow rate of the coating liquid (measured using a flowmeter for coating liquid (product name: CN015C-SS-440K, manufactured by OVAL Corporation)) was adjusted to 1.75 cc/(cm×sec).

Also, the width of the curtain film (curtain fall width) was adjusted to 230 mm.

(3) Shape, Size and Material of Edge Guide

The edge guide was made to have the cross-sectional shape shown in FIG. 19, and the angle θ in FIG. 19 was set at 60°.

The size of the edge guide was set such that the flow-down surface length L (FIG. 16) was 145 mm, the maximum gap G (FIG. 16) of the auxiliary water introduction port was 0.2 mm, the maximum width W (FIG. 16) of the auxiliary water introduction port was 3 mm, the maximum depth h (FIG. 19) of the auxiliary water flow-down groove (concave portion) was 0.5 mm and the maximum width W (FIG. 19) of the auxiliary water flow-down groove (concave portion) was 3 mm.

The material for the edge guide was SUS420J2.

(4) Supply of Edge Guide Auxiliary Water

The edge guide auxiliary water was supplied from a pressurized tank which was pressurized to 0.2 MPa to the edge guide via a micro-motion flowmeter (manufactured by OVAL Corporation) (flowmeter main body: E010S-SS-311, transmitter: RFT9739-3MD11, integrator: EL0122-132011) and a float-type flowmeter (P100L-4, manufactured by TOKYO KEISO CO., LTD.). The opening degree of a metering valve of the float-type flowmeter was adjusted and, by means of conversion from the flow rate, the introduction rate of the edge guide auxiliary water was set at 0.8 m/sec.

<Evaluation Method>

As a method for grasping the effects of disturbance, a wind of approximately 0.5 m/s in wind velocity (measured using ANEMOMASTER WIND VELOCITY METER MODEL 6141, manufactured by Kanomax Japan, Inc.) was applied in two directions, i.e. from in front of the curtain film to the curtain film perpendicularly, and from in front of the curtain film to the vicinity of the edge guide, and evaluations were thus carried out. The foregoing wind velocity was set as a result of supposing airflow in the vicinity of the coating head caused, for example, by air which accompanies a rotating base material on a roll, and airflow caused at the time of operations such as movement of an operator of the coating apparatus and adjustment of a gap in the vicinity of the coating apparatus.

(i) Stability of Curtain Film against Disturbance such as Wind

—Evaluation Criteria—

A: The curtain film did not shake

B: The curtain film shook.

(ii) Presence or Absence of Turbulent Flow in the vicinity of Edge Guide

—Evaluation Criteria—

A: Turbulent flow did not arise.

B: Turbulent flow scarcely arose.

C: Turbulent flow arose, or there was a problem with the flow of the auxiliary water.

(iii) Presence or Absence of Phenomenon in which Edge Guide Auxiliary Water did not Flow on Entire Surface (Phenomenon in which Auxiliary Water Flowed in the form of String) and of Turbulent Flow at Lower Portion of Edge Guide —Evaluation Criteria—

A: Turbulent flow did not arise, and the auxiliary water did not flow down in the form of a string.

B: Turbulent flow did not arise, but there was a case where the auxiliary water flowed down in the form of a string.

C: Turbulent flow arose, and there was a case where the auxiliary water flowed down in the form of a string.

(iv) Flow Rate Distribution of Curtain Film with respect to Width Direction

—Evaluation Conditions—

(a) Position where Flow Rate of Falling Curtain Film was Measured;

(i) Position of Curtain Film with respect to Width Direction; the flow rate was measured at a pitch of 2.5 mm in an area lying between the bottom surface of the auxiliary water flow-down groove (concave portion) and a position which was apart by 20 mm from the bottom surface of the auxiliary water flow-down groove (concave portion) toward the center with respect to the curtain width direction; the flow rate was measured at a pitch of 5 mm in an area lying between a position which was apart by 20 mm from the bottom surface of the auxiliary water flow-down groove (concave portion) toward the center with respect to the curtain width direction and a position which was apart by 50 mm from the bottom surface of the auxiliary water flow-down groove (concave portion) toward the center with respect to the curtain width direction; and the flow rate was measured at a pitch of 25 mm in an area lying between a position which was apart by 50 mm from the bottom surface of the auxiliary water flow-down groove (concave portion) toward the center with respect to the curtain width direction and the center with respect to the curtain width direction (i.e. a position which was apart by 125 mm from the bottom surface of the auxiliary water flow-down groove (concave portion).

(ii) Position of Curtain Film with respect to Height Direction: 140 mm below the upper edge of the curtain film (b) Flow Rate Measuring Method: a gutter (4 mm in width and 5 mm in depth) produced by folding a plate (0.1 mm in thickness) of SUS304 was used to intercept the curtain liquid film. The amount of the liquid falling into the gutter was measured in accordance with a gravimetric method and defined as the flow rate of the falling curtain film. The measurement values were normalized such that values in relation to widthwise positions lying between the position which was apart by 50 mm from the bottom surface of the auxiliary water flow-down groove (concave portion) and the center with respect to the curtain width direction (i.e. the position which was apart by 125 mm from the bottom surface of the auxiliary water flow-down groove (concave portion) were defined as 100%, and a flow rate distribution was thus obtained.

—Evaluation Criteria—

A: The thickness of a thick film portion was less than 110% of the average thickness.

B: The thickness of a thick film portion was 110% or more, but less than 120% of the average thickness.

C: The thickness of a thick film portion was 120% or more of the average thickness.

Comparative Example B-1

Figure 18:
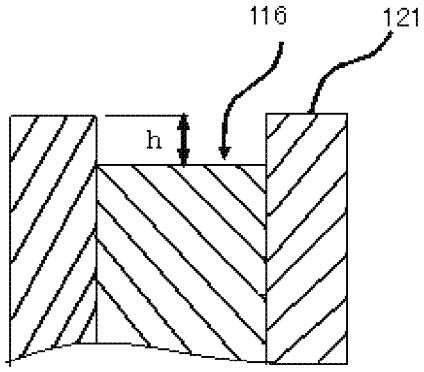
FIG. 18 is a cross-sectional view showing an example of an edge guide (guiding unit) in a conventional curtain coating apparatus.

Curtain coating and (i) the stability of the curtain film against disturbance such as wind were evaluated in the same manner as in Example B-1 except that the edge guide was made to have the cross-sectional shape shown in FIG. 18 (the angle A in FIG. 18 is 90°) instead of the cross-sectional shape shown in FIG. 19. The evaluation results are shown in Table 8.

Comparative Example B-2

Curtain coating and (i) the stability of the curtain film against disturbance such as wind were evaluated in the same manner as in Example B-1 except that the edge guide was made to have a flat cross-sectional shape without an auxiliary water flow-down groove (concave portion), instead of the cross-sectional shape shown in FIG. 19. The evaluation results are shown in Table 8.

TABLE 8

| | Flow down state of curtain film | Evaluation result |
|---|---|---|
| Example A-1 | The curtain film was very stable, fell perpendicularly and was resistant to wind. | A |
| Comparative Example A-1 | The curtain film was stable, but shifted onto side walls of the edge guide, affected by wind. | B |
| Comparative Example A-2 | The curtain film curved, did not fall linearly, and shook backward and forward, affected by wind. | B |

Figure 20:
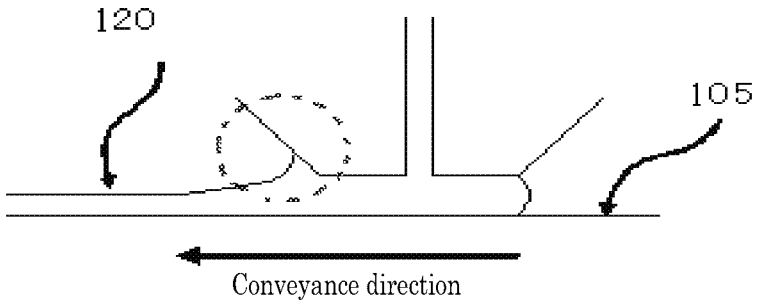
FIG. 20 is a drawing for explaining die coating (Part 1).
Figure 21:
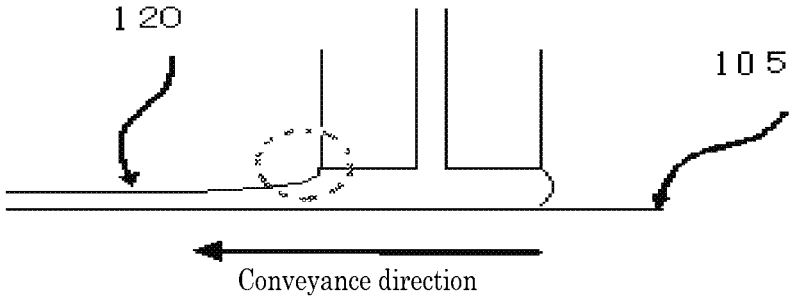
FIG. 21 is a drawing for explaining die coating (Part 2).

It has been found that, in die coating, as shown by the dotted lines in FIGS. 20 and 21, a coating film 120 wetly rises to a lesser extent and formation of streaks is less likely, when a lip edge on the downstream side of a coating portion (122) rises at an angle of 90° (FIG. 21) rather than at an obtuse angle (FIG. 20).

Meanwhile, regarding the edge guides, Example B-1 employing the edge guide having the shape in FIG. 19 (the angle θ in FIG. 19 is 60°) yielded greater pinning effects on the edge guide auxiliary water at the edges than Comparative Example B-1 employing the edge guide having the shape in FIG. 18 (the angle θ in FIG. 19 is 90°).

In the case of die coating, there is no problem caused with a lip edge having a shape as shown in FIG. 21 (the lip edge on the downstream side rises at an angle of approximately 90°) because a coating film is subject to force acting only in one direction caused by pulling of a base material when a free surface is created as the coating film separates from between the lip and the base material. In the case of the edge guides, however, it is inferred that since the auxiliary water is subject to force acting in two directions, i.e. the falling direction and the direction of the pulling of the curtain film, it is possible to effectively suppress rising (in a wet manner) of the coating film and yield greater pinning effects on the edge guide auxiliary water at the edges, when the angle θ is an acute angle (smaller than 90°).

Example B-2

Curtain coating and (ii) the presence or absence of turbulent flow in the vicinity of the edge guide were evaluated in the same manner as in Example B-1 except that the maximum depth h (FIG. 19) of the auxiliary water flow-down groove (concave portion) was changed from 0.5 mm to 0.2 mm. The evaluation results are shown in Table 9.

Example B-3

Curtain coating and (ii) the presence or absence of turbulent flow in the vicinity of the edge guide were evaluated in the same manner as in Example B-1 except that the maximum depth h (FIG. 19) of the auxiliary water flow-down groove (concave portion) was changed from 0.5 mm to 0.3 mm. The evaluation results are shown in Table 9.

Example B-4

Curtain coating and (ii) the presence or absence of turbulent flow in the vicinity of the edge guide were evaluated in the same manner as in Example B-1 except that the maximum depth h (FIG. 19) of the auxiliary water flow-down groove (concave portion) was changed from 0.5 mm to 0.6 mm. The evaluation results are shown in Table 9.

Example B-5

Curtain coating and (ii) the presence or absence of turbulent flow in the vicinity of the edge guide were evaluated in the same manner as in Example B-1 except that the maximum depth h (FIG. 19) of the auxiliary water flow-down groove (concave portion) was changed from 0.5 mm to 0.1 mm. The evaluation results are shown in Table 9.

Example B-6

Curtain coating and (ii) the presence or absence of turbulent flow in the vicinity of the edge guide were evaluated in the same manner as in Example B-1 except that the maximum depth h (FIG. 19) of the auxiliary water flow-down groove (concave portion) was changed from 0.5 mm to 0.7 mm. The evaluation results are shown in Table 9.

TABLE 9

| | Maximum depth h of auxiliary water flow-down groove (concave portion) (mm) | Flow down state of curtain film | Evaluation |
|---|---|---|---|
| Example B-1 | 0.5 | Turbulent flow did not arise. | A |
| Example B-2 | 0.2 | Turbulent flow did not arise. | A |
| Example B-3 | 0.3 | Turbulent flow did not arise. | A |
| Example B-4 | 0.6 | Turbulent flow scarcely arose. | B |
| Example B-5 | 0.1 | There was a case where the edge guide auxiliary water over-flowed at the upper portion. | B |

TABLE 9-continued

| | Maximum depth h of auxiliary water flow-down groove (concave portion) (mm) | Flow down state of curtain film | Evaluation |
|---|---|---|---|
| Example B-6 | 0.7 | There was a case where turbulent flow arose at the lower portion. | B |

In Examples B-1 to B-3, turbulent flow did not arise, whereas in Example B-4, there was a case where turbulent flow arose. Meanwhile, in Example B-5, there was a case where the edge guide auxiliary water overflowed at the upper portion and, in Example B-6, there was a case where turbulent flow arose at the lower portion and thus the curtain film was disturbed.

The results shown in Table 9 demonstrate that the maximum depth h (FIG. 19) of the auxiliary water flow-down groove (concave portion) is related to the occurrence of turbulent flow of the curtain film in the vicinity of the edge guide, and that the maximum depth h (FIG. 19) of the auxiliary water flow-down groove (concave portion) is preferably in the range of 0.2 mm to 0.5 mm.

Example B-7

Curtain coating, (iii) the presence or absence of a phenomenon in which the edge guide auxiliary water did not flow on the entire surface (a phenomenon in which the auxiliary water flowed in the form of a string), and the presence or absence of turbulent flow at the lower portion of the edge guide were evaluated in the same manner as in Example B-1 except that the maximum width W (FIG. 19) of the auxiliary water flow-down groove (concave portion) was changed from 3 mm to 1.5 mm. The evaluation results are shown in Table 10.

Example B-8

Curtain coating, (iii) the presence or absence of a phenomenon in which the edge guide auxiliary water did not flow on the entire surface (a phenomenon in which the auxiliary water flowed in the form of a string), and the presence or absence of turbulent flow at the lower portion of the edge guide were evaluated in the same manner as in Example B-1 except that the maximum width W (FIG. 19) of the auxiliary water flow-down groove (concave portion) was changed from 3 mm to 4 mm. The evaluation results are shown in Table 10.

Example B-9

Curtain coating, (iii) the presence or absence of a phenomenon in which the edge guide auxiliary water did not flow on the entire surface (a phenomenon in which the auxiliary water flowed in the form of a string), and the presence or absence of turbulent flow at the lower portion of the edge guide were evaluated in the same manner as in Example B-1 except that the maximum width W (FIG. 19) of the auxiliary water flow-down groove (concave portion) was changed from 3 mm to 5 mm. The evaluation results are shown in Table 10.

Example B-10

Curtain coating, (iii) the presence or absence of a phenomenon in which the edge guide auxiliary water did not flow on the entire surface (a phenomenon in which the auxiliary water flowed in the form of a string), and the presence or absence of turbulent flow at the lower portion of the edge guide were evaluated in the same manner as in Example B-1 except that the maximum width W (FIG. 19) of the auxiliary water flow-down groove (concave portion) was changed from 3 mm to 7 mm. The evaluation results are shown in Table 10.

Example B-11

Curtain coating, (iii) the presence or absence of a phenomenon in which the edge guide auxiliary water did not flow on the entire surface (a phenomenon in which the auxiliary water flowed in the form of a string), and the presence or absence of turbulent flow at the lower portion of the edge guide were evaluated in the same manner as in Example B-1 except that the maximum width W (FIG. 19) of the auxiliary water flow-down groove (concave portion) was changed from 3 mm to 1 mm. The evaluation results are shown in Table 10.

Example B-12

Curtain coating, (iii) the presence or absence of a phenomenon in which the edge guide auxiliary water did not flow on the entire surface (a phenomenon in which the auxiliary water flowed in the form of a string), and the presence or absence of turbulent flow at the lower portion of the edge guide were evaluated in the same manner as in Example B-1 except that the maximum width W (FIG. 19) of the auxiliary water flow-down groove (concave portion) was changed from 3 mm to 8 mm. The evaluation results are shown in Table 10.

TABLE 10

| | Maximum width W of auxiliary water flow-down groove (concave portion) (mm) | Flow down state of curtain film | Flow in the form of string | Effect of turbulent flow |
|---|---|---|---|---|
| Example B-1 | 3 | The curtain film flowed down without being disturbed. | A | A |
| Example B-7 | 1.5 | The curtain film flowed down without being disturbed. | A | A |
| Example B-8 | 4 | The curtain film flowed down without being disturbed. | A | A |

TABLE 10-continued

| | Maximum width W of auxiliary water flow-down groove (concave portion) (mm) | Flow down state of curtain film | Flow in the form of string | Effect of turbulent flow |
|---|---|---|---|---|
| Example B-9 | 5 | The curtain film flowed down without being disturbed, but there was a case where the auxiliary water did not flow down on the entire surface. | B | A |
| Example B-10 | 7 | The curtain film flowed down without being disturbed, but there was a case where the auxiliary water did not flow down on the entire surface. | B | A |
| Example B-11 | 1 | There was a case where the auxiliary water flowed with difficulty, and there was a case where the auxiliary water overflowed. | B | B |
| Example B-12 | 8 | There was a case where the curtain film became unstable, and there was a case where turbulent flow arose at the lower portion | B | B |

A phenomenon occurred where the auxiliary water deviated toward side surfaces of the edge guide and stabilized, which was because the thickness of the curtain film was small in comparison with the maximum width W of the auxiliary water flow-down groove (concave portion). It was inferred from the foregoing that a reduction in the maximum width W of the auxiliary water flow-down groove in the edge guide yielded an effect of stabilizing the curtain film. Also, since the auxiliary water was stable when it deviated toward the side surfaces of the edge guide, it was inferred that by reducing the maximum width W of the auxiliary water flow-down groove (concave portion) to such an extent that each edge of the auxiliary water could be held by the concave portion side surfaces, the curtain film stabilized.

In Examples B-1, B-7 and B-8, the curtain film flowed without being disturbed, and the auxiliary water flowed on the entire bottom surface of the flow-down groove. In Examples B-9 and B-10, the curtain film flowed without being disturbed, but the auxiliary water did not flow down on the entire surface.

In Example B-11, there was a case where the auxiliary water poorly flowed, and there was a case where the auxiliary water overflowed.

In Example B-12, there was a case where turbulent flow arose at the lower portion.

The results shown in Table 10 demonstrate that the maximum distance between the concave portion side surfaces (maximum width of the auxiliary water flow-down groove (concave portion)) W has an effect on the downward flow of the auxiliary water, and that the curtain film further stabilizes by adjusting the maximum distance to the range of 1.5 mm to 4 mm.

Example B-13

Curtain coating and (iv) the flow rate distribution of the curtain film with respect to the width direction were evaluated in the same manner as in Example B-1 except that the auxiliary water introduction rate was changed from 0.8 m/sec (equivalent flow rate: 50 cc/min) to 0.4 m/sec (equivalent flow rate: 25 cc/min). The evaluation results are shown in Table 11.

Example B-14

Curtain coating and (iv) the flow rate distribution of the curtain film with respect to the width direction were evaluated in the same manner as in Example B-1 except that the auxiliary water introduction rate was changed from 0.8 m/sec (equivalent flow rate: 50 cc/min) to 1.6 m/sec (equivalent flow rate: 100 cc/min). The evaluation results are shown in Table 11.

Example B-15

Curtain coating and (iv) the flow rate distribution of the curtain film with respect to the width direction were evaluated in the same manner as in Example B-1 except that the auxiliary water introduction rate was changed from 0.8 m/sec (equivalent flow rate: 50 cc/min) to 1.7 m/sec (equivalent flow rate: 106 cc/min). The evaluation results are shown in Table 11.

Example B-16

Curtain coating and (iv) the flow rate distribution of the curtain film with respect to the width direction were evaluated in the same manner as in Example B-1 except that the auxiliary water introduction rate was changed from 0.8 m/sec (equivalent flow rate: 50 cc/min) to 2.0 m/sec (equivalent flow rate: 125 cc/min). The evaluation results are shown in Table 11.

Example B-17

Curtain coating and (iv) the flow rate distribution of the curtain film with respect to the width direction were evaluated in the same manner as in Example B-1 except that the auxiliary water introduction rate was changed from 0.8 m/sec (equivalent flow rate: 50 cc/min) to 2.1 m/sec (equivalent flow rate: 131 cc/min). The evaluation results are shown in Table 11.

Example B-18

Curtain coating and (iv) the flow rate distribution of the curtain film with respect to the width direction were evaluated in the same manner as in Example B-1 except that the auxiliary water introduction rate was changed from 0.8 m/sec (equivalent flow rate: 50 cc/min) to 0.2 m/sec (equivalent flow rate: 12.5 cc/min). The evaluation results are shown in Table 11.

Example B-19

Curtain coating and (iv) the flow rate distribution of the curtain film with respect to the width direction were evaluated in the same manner as in Example B-1 except that the auxiliary water introduction rate was changed from 0.8 m/sec (equivalent flow rate: 50 cc/min) to 0.35 m/sec (equivalent flow rate: 22 cc/min). The evaluation results are shown in Table 11.

Example B-20

Curtain coating and (iv) the flow rate distribution of the curtain film with respect to the width direction were evaluated in the same manner as in Example B-1 except that the auxiliary water introduction rate was changed from 0.8 m/sec (equivalent flow rate: 50 cc/min) to 2.5 m/sec (equivalent flow rate: 156 cc/min). The evaluation results are shown in Table 11.

TABLE 11

| | Auxiliary water introduction rate (m/sec) | Data on flow rate distribution of curtain film | | Evaluation |
|---|---|---|---|---|
| | | Thick film portion | Thin film portion | |
| Example B-1 | 0.8 | 10 mm, +8.1% | 2.5 mm, −12.0% | A |
| Example B-13 | 0.4 | 12.5 mm, +10.2% | 2.5 mm, −12.1% | A |
| Example B-14 | 1.6 | 10 mm, +9.0% | 2.5 mm, −11.1% | A |
| Example B-15 | 1.7 | 10 mm, +10.1% | 2.5 mm, −8.5% | A |
| Example B-16 | 2.0 | 12.5 mm, +8.5% | 2.5 mm, −7.5% | A |
| Example B-17 | 2.1 | 12.5 mm, +8.9% | 2.5 mm, −7.4% | A |
| Example B-18 | 0.2 | 10 mm, +20.1% | 2.5 mm, −33.5% | B |
| Example B-19 | 0.35 | 10 mm, +16.0% | 2.5 mm, −18.2% | B |
| Example B-20 | 2.5 | The edge guide auxiliary water was ejected diagonally and downward. | | B |

In Table 11, the numbers in the column of "thick film portion" denote the distance (with respect to the curtain width direction) between the measurement point where the flow rate was greatest and the bottom surface of the auxiliary water flow-down groove (concave portion), and the difference from a reference value (100%). The numbers in the column of "thin film portion" denote the distance (with respect to the curtain width direction) between the measurement point where the flow rate was smallest and the bottom surface of the auxiliary water flow-down groove (concave portion), and the difference from the reference value (100%).

Parenthetically, in Example B-20, since the edge guide auxiliary water was ejected diagonally and downward, Example B-20 was not an object of evaluation.

In making a comparison between Examples B-1 and B-13 to B-17 and Examples B-18 and B-19 based upon the results shown in Table 11, it has been found that, in both these cases, thick film portions were formed at positions which were apart from the bottom surface of the auxiliary water flow-down groove (concave portion) by 10 mm to 25 mm, and that the flow rates at the thick film portions in Examples B-1 and B-13 to B-17 could be made lower than in Examples B-18 and B-19 by approximately 10%. Also, it has been found that, in both Examples B-1 and B-13 to B-17 and Examples B-18 and B-19, thin film portions improved. As the introduction rate of the auxiliary water gradually increases from 0.2 m/sec, it becomes possible to suppress increase in the thickness of the curtain film more effectively. It should, however, be noted that when the introduction rate is approximately 2.0 m/sec or higher, no major difference is confirmed (in terms of the effect of suppressing increase in film thickness) even if the introduction rate is made even higher. Hence, it has been found that the introduction rate of the auxiliary water is preferably in the range of 0.4 m/sec to 2.0 m/sec.

Example B-21

Curtain coating and (iv) the flow rate distribution of the curtain film with respect to the width direction were evaluated in the same manner as in Example B-1 except that the slot die curtain coating apparatus shown in FIG. 13 was used instead of the slide die curtain coating apparatus shown in FIG. 12. The evaluation results are shown in Table 12 and FIG. 26.

TABLE 12

| | Profile of curtain film flow rate |
|---|---|
| Example B-1 (Slide curtain coating) | Thick film portion: +8.1%, thin film portion: −12.0% |
| Example B-21 (Slot curtain coating) | The size of a thick film portion was very small, and no extremely thin film portion existed. The difference from the reference value was within ±4% with respect to the entire width. |

Figure 26:
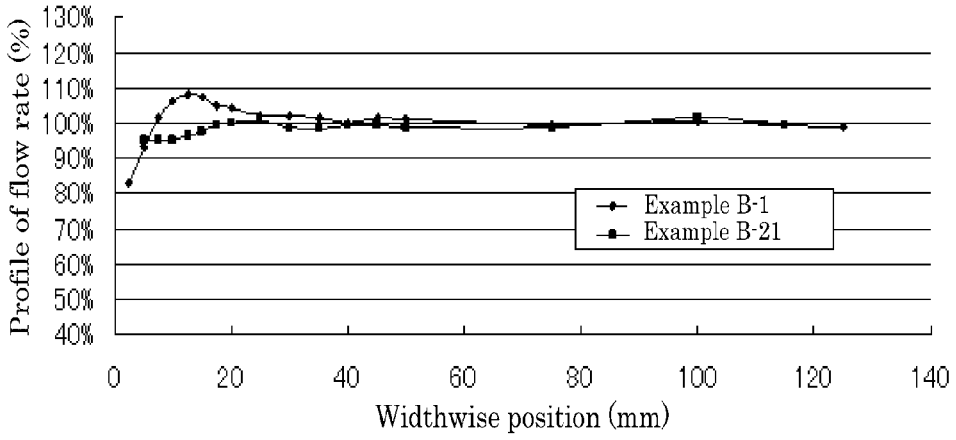
FIG. 26 is a graph showing the result of an evaluation of the flow rate distributions of curtain films with respect to a width direction, regarding Examples B-1 and B-21.

Example B-1 is represented by a flow rate profile concerning slide curtain coating. In Example B-1, there were a thick portion and a thin portion already existing when the curtain film was formed, owing to effects of a boundary layer formed at a slide flow-down portion, and thus it was difficult to further suppress formation of a thick portion and a thin portion. Accordingly, slot curtain coating was employed as in Example B-21 to further suppress formation of a thick portion and a thin portion. Thus, as shown in FIG. 26, there was no thick film portion formed, there was no extremely thin film portion formed, and the difference from the reference value was within ±4% with respect to the entire width.

Formation of a thick film portion could be further lessened in the slot curtain coating. Accordingly, it was possible to suppress increase in the thickness of the curtain film by suppressing formation of a boundary layer at the falling portion of the curtain film.

Figure 24:
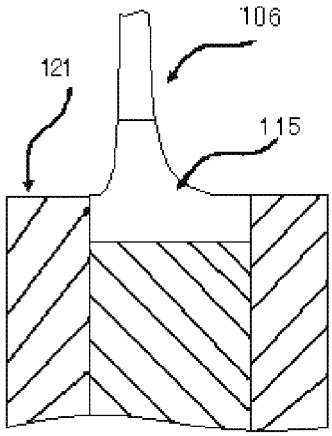
FIG. 24 is a drawing for explaining a boundary layer lying between a curtain film and auxiliary water.
Figure 25:
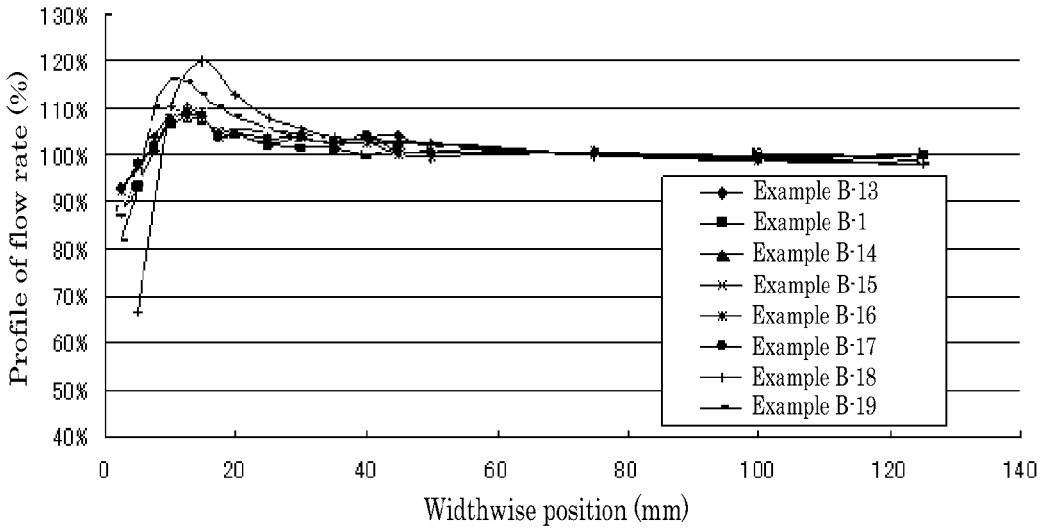
FIG. 25 is a graph showing the result of an evaluation of the flow rate distributions of curtain films with respect to a width direction, regarding Examples B-1, and B-13 to B-19.

Regarding Examples B-1, B-13, B-14 and B-18, the fall velocities of the curtain film at heights of 10 mm and 140 mm from the lower edge of the slide die were measured using a fall velocity measuring apparatus (Laser Doppler Noncontact Velocity Meter, Type MODEL 1110A, manufactured by ACT Electronics Corp.), and examinations were carried out as to how a boundary layer (such as is shown in FIG. 24) in the vicinity of the edge guide changed and how the boundary layer affected the thickness distribution of the curtain film. The results are shown in Table 13 and FIGS. 27 and 28.

TABLE 13

| | Auxiliary water introduction rate (m/sec) | Data on fall velocity: Position apart from lower edge of slide die by 10 mm | Data on fall velocity: Position apart from lower edge of slide die by 140 mm |
|---|---|---|---|
| Example B-13 | 0.4 | The fall velocity of the curtain film was lower than the average fall velocity, as far as a position apart from the bottom surface of the concave portion by 2.5 mm. | The fall velocity of the curtain film was low only in the immediate vicinity of the edge guide, and was lower than the average fall velocity (−3.2%). |
| Example B-1 | 0.8 | The fall velocity of the curtain film was lower than the average fall velocity, as far as a position apart from the bottom surface of the concave portion by 2.5 mm. | There was almost no velocity distribution, with the difference from the average fall velocity being within ±0.21% with respect to the entire width. |
| Example B-21 | 1.6 | The fall velocity of the curtain film was lower than the average fall velocity, as far as a position apart from the bottom surface of the concave portion by 2.5 mm. | The fall velocity of the curtain film was higher than the average fall velocity (+5.1%), as far as a position apart from the bottom surface of the concave portion by 15 mm. |
| Example B-18 | 0.2 | The fall velocity of the curtain film was lower than the average fall velocity, as far as a position apart from the bottom surface of the concave portion by 5 mm. | A boundary layer was formed, and the fall velocity of the curtain film was lower than the average fall velocity (−9.5%), in the immediate vicinity of the edge guide. Thus, there was a clear velocity distribution. |

Figure 27:
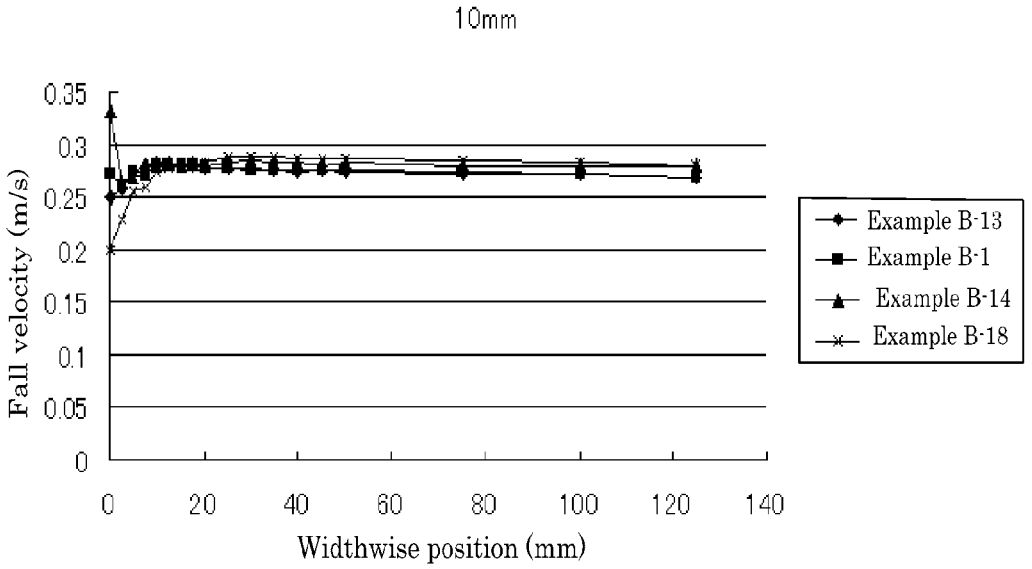
FIG. 27 is a graph showing the result of an evaluation of the fall velocities of curtain films, measured at a height of 10 mm from the bottom of a slide die, regarding Examples B-1, B-13, B-14 and B-18.
Figure 28:
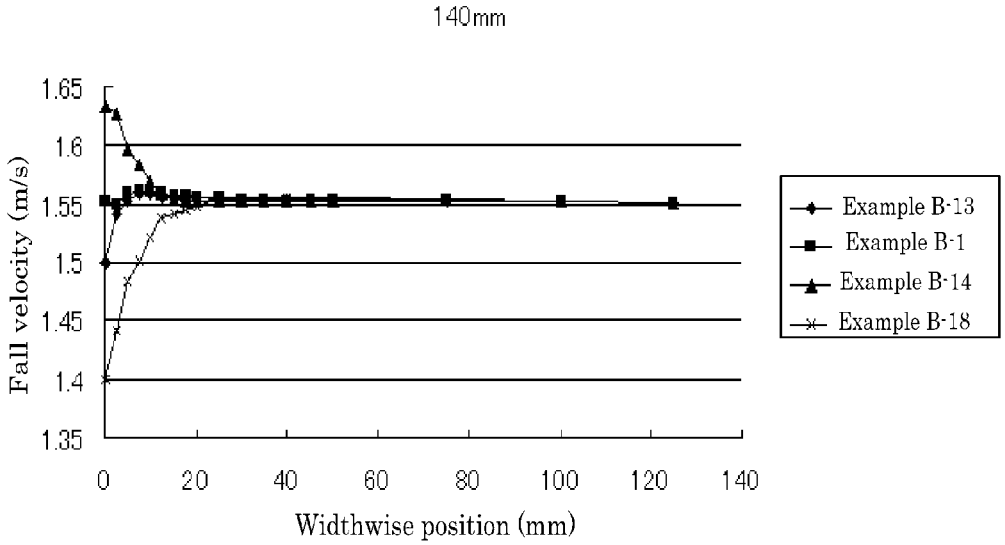
FIG. 28 is a graph showing the result of an evaluation of the fall velocities of curtain films, measured at a height of 140 mm from the bottom of a slide die, regarding Examples B-1, B-13, B-14 and B-18.

In making a comparison between Examples B-1, B-13 and B-21 and Example B-18 based upon the results shown in Table 13 and FIGS. 27 and 28, it has been found that Examples B1, B-13 and B-21 were superior to Example B-18 in that a velocity distribution of the curtain film (formed as the coating liquid flowed down the slide portion of the slide die) was removed as the curtain film fell and thus it was possible to suppress formation of a thick film portion.

As described above, it has been found possible to eliminate the phenomenon in which the edge guide auxiliary water does not flow on the entire surface but deviates toward the edges, prevent the occurrence of turbulent flow of the curtain film, and stabilize the curtain film against wind-based disturbance.

Also, the following has been found: by adjusting the introduction rate of the auxiliary water to the range of 0.4 m/sec to 2.1 m/sec, it is possible to greatly reduce the extent of the presence of a boundary layer and to suppress or control formation of the boundary layer; thus, the removal of the boundary layer makes it possible to suppress both increase and decrease in the thickness of the curtain film.

A curtain coating apparatus and a curtain coating method according to the present invention can, for example, be suitably used for producing silver halide photographic sensitized materials, magnetic recording materials, pressure-sensitive/thermosensitive recording papers, art papers, coated papers, inkjet recording sheets and so forth.

What is claimed is:

1. A curtain coating apparatus comprising:

a pair of edge guides configured to support both side edges of at least one coating liquid so as to form a coating liquid film which falls freely and apply the coating liquid film onto a continuously running support; and an auxiliary water introduction port which allows auxiliary water to be introduced substantially uniformly with respect to a width direction of an edge guide auxiliary water flow-down surface of each edge guide from an upper portion toward a lower portion of the edge guide auxiliary water flow-down surface, wherein the edge guide auxiliary water flow-down surface has at its upper portion a flat surface portion which is substantially in the form of a flat surface, wherein the edge guide auxiliary water flow-down surface has at its lower portion an arc-shaped portion which is provided at a center with respect to the width direction and which protrudes in the shape of an arc, and a flat surface portion which is provided on both sides of the arc-shaped portion with respect to the width direction, and wherein the arc-shaped portion extends from one side of the flat surface portion to the other side of the flat surface portion in a smooth continuous manner.

2. The curtain coating apparatus according to claim 1, wherein the arc-shaped portion has a curvature radius of 2 mm to 5 mm.

3. The curtain coating apparatus according to claim 1, wherein there is a continuous shape change from the flat surface portion at the upper portion of the edge guide auxiliary water flow-down surface to the arc-shaped portion at the lower portion of the edge guide auxiliary water flow-down surface.

4. The curtain coating apparatus according to claim 1, wherein the edge guide auxiliary water flow-down surface has arc-shaped areas provided along oblique sides of an inverted isosceles triangle which connect a center line of the arc-shaped portion with respect to the width direction with both ends of the flat surface portion provided at the upper portion of the edge guide auxiliary water flow-down surface.

5. The curtain coating apparatus according to claim 4, wherein the distance between the auxiliary water introduction port and an apex of the isosceles triangle is in the range of 10 mm to 35 mm.

6. The curtain coating apparatus according to claim 1, wherein the auxiliary water is introduced at a rate of 0.40 msec to 1.20 msec.

7. A curtain coating apparatus comprising:

an ejecting unit having a coating liquid ejection port, configured to eject a coating liquid from the coating liquid ejection port;

a pair of guiding units each having an auxiliary water introduction port through which auxiliary water is introduced, configured to support both edges of a curtain film with respect to a width direction substantially perpendicular to the direction in which the curtain film formed of the coating liquid flows down, and guide the curtain film onto a support conveyed; and a conveying unit configured to convey the support, wherein the pair of guiding units each have a concave portion through which the auxiliary water flows down, wherein a side surface of the concave portion formed substantially perpendicularly to a bottom surface of the concave portion forms an acute angle with an exposed surface formed so as to be continuous with the side surface and intersect the side surface, and wherein each of the side surface of the concave portion and the bottom surface of the concave portion is a flat planar surface free of grooves.

8. The curtain coating apparatus according to claim 7, wherein the concave portion has a maximum depth of 0.2 mm to 0.5 mm.

9. The curtain coating apparatus according to claim 7, wherein the maximum distance between the side surface and the other side surface of the concave portion is in the range of 1.5 mm to 4.0 mm.

10. The curtain coating apparatus according to claim 7, wherein each guiding unit has a flat surface above the auxiliary water introduction port with respect to the direction in which the auxiliary water flows down, and wherein the flat surface is a rectangle which measures 5 mm to 15 mm long and 7 mm or more wide.

11. The curtain coating apparatus according to claim 7, wherein the auxiliary water is introduced at a rate of 0.4 msec to 2.1 in/sec.

12. The curtain coating apparatus according to claim 7, wherein the auxiliary water introduction port has a maximum gap of 0.2 mm to 0.5 mm with respect to the direction in which the auxiliary water flows down.

* * * * *